US012733760B2

(12) United States Patent
Tsutsui

(10) Patent No.: US 12,733,760 B2
(45) Date of Patent: Sep. 15, 2026

(54) ASSEMBLEABLE CONTAINER

(71) Applicant: Tsutsui LLC, Kanagawa (JP)

(72) Inventor: Eitaro Tsutsui, Kanagawa (JP)

(73) Assignee: TSUTSUI LLC, Kanagawa (JP)

( * ) Notice: Subject to any disclaimer, the term of this patent is extended or adjusted under 35 U.S.C. 154(b) by 184 days.

(21) Appl. No.: 18/568,623

(22) PCT Filed: Oct. 12, 2022

(86) PCT No.: PCT/JP2022/038086
§ 371 (c)(1),
(2) Date: Dec. 8, 2023

(87) PCT Pub. No.: WO2023/068144
PCT Pub. Date: Apr. 27, 2023

(65) Prior Publication Data

US 2024/0268584 A1 Aug. 15, 2024

(30) Foreign Application Priority Data

Oct. 18, 2021 (JP) ..... 2021-170032
May 17, 2022 (JP) ..... 2022-080684

(51) Int. Cl.
*A47G 19/23* (2006.01)

(52) U.S. Cl.
CPC ..... *A47G 19/23* (2013.01)

(58) Field of Classification Search
CPC ..... A47G 19/23; A47G 19/2205; A47G 19/2255; A45F 3/16; B65D 11/04; B65D 13/02
See application file for complete search history.

(56) References Cited

U.S. PATENT DOCUMENTS 640,860 A * 1/1900 Baum ..... B65D 1/06 215/377
1,668,411 A * 5/1928 Kindervater ..... F22B 37/223 220/304

(Continued)

FOREIGN PATENT DOCUMENTS

CN 201614074 U 10/2010
CN 203776561 U 8/2014

(Continued)

OTHER PUBLICATIONS

Jun. 29, 2025, Chinese Office Action issued for related CN Application No. 202280041481.3.

(Continued)

*Primary Examiner* — Andrew D Perreault
(74) *Attorney, Agent, or Firm* — Paratus Law Group, PLLC

(57) ABSTRACT

An assembleable container for storing a liquid includes an upper main body having a first connector and a lower main body having a second connector. The first connector has a convex portion or a concave portion formed on an outer periphery of the upper main body. The second connector has a concave portion or a convex portion that is formed on an inner periphery of the lower main body and configured to fit into the convex portion or the concave portion of the first connector. When the first connector and the second connector are coupled to each other, a bottom surface of the first connector and a bottom surface of the second connector are disposed facing each other. The first connector and the second connector are coupled to provide a leakage prevention portion for preventing the liquid from leaking.

9 Claims, 14 Drawing Sheets

(56) References Cited

U.S. PATENT DOCUMENTS

| | | | | |
|---|---|---|---|---|
| 2,169,426 | A * | 8/1939 | Morton | A47G 19/2288 215/377 |
| 3,915,296 | A | 10/1975 | Spencer | |
| D752,923 | S | 4/2016 | Lee | |
| 11,540,653 | B2 * | 1/2023 | Haug | A47G 19/2255 |
| 2004/0011825 | A1 | 1/2004 | McLelland et al. | |
| 2008/0264958 | A1 * | 10/2008 | Blake | B65D 41/56 220/703 |
| 2010/0288759 | A1 | 11/2010 | Hotell | |
| 2011/0174763 | A1 | 7/2011 | Kennedy | |
| 2012/0091131 | A1 | 4/2012 | Arjomand | |
| 2014/0291335 | A1 | 10/2014 | Lee | |
| 2014/0353309 | A1 * | 12/2014 | Albers | A47G 19/23 206/517 |
| 2016/0058227 | A1 | 3/2016 | Albers | |
| 2016/0073811 | A1 | 3/2016 | Bell et al. | |
| 2016/0100702 | A1 * | 4/2016 | Albers | A47G 19/2205 206/517 |

FOREIGN PATENT DOCUMENTS

| | | | |
|---|---|---|---|
| CN | 207506324 | U | 6/2018 |
| EP | 0635435 | A1 | 7/1994 |
| JP | 2015-500697 | A | 1/2015 |
| JP | 3227658 | U | 9/2020 |
| KR | 20-0353874 | Y1 | 6/2004 |

OTHER PUBLICATIONS

Dec. 27, 2022, International Search Report issued for related PCT Application No. PCT/JP2022/038086.

Dec. 27, 2022, International Search Opinion issued for related PCT Application No. PCT/JP2022/038086.

Sep. 9, 2025, European Search Report Issued for related EP Application No. 22883448.7.

Nov. 14, 2025, Chinese Office Action Issued for related CN Application No. 202280041481.3.

Dec. 9, 2025, European Search Report Issued for related EP Application No. 22883448.7.

* cited by examiner

ASSEMBLEABLE CONTAINER

CROSS REFERENCE TO PRIOR APPLICATION

This application is a National Stage Patent Application of PCT International Patent Application No. PCT/JP2022/038086 (filed on Oct. 12, 2022) under 35 U.S.C. § 371, which claims priority to Japanese Patent Application Nos. 2021-170032 (filed on Oct. 18, 2021) and 2022-080684 (filed on May 17, 2022), which are all hereby incorporated by reference in their entirety.

TECHNICAL FIELD

The present invention relates to an assembleable container.

BACKGROUND ART

A container such as a wine glass is generally made of glass and therefore breaks easily and must be handled with care. A ball portion into which a liquid is poured and a plate for supporting the container are integrally formed.

Patent Literature 1 (JP2015-500697A) discloses a wine glass that is easy to carry. In this wine glass, a storage portion into which a user can pour wine and drink the wine and a stem to which a plate is connected can be attached and detached using a magnet to make the wine glass easy to carry, and when carrying the wine glass, the stem can be stored in the storage portion.

CITATION LIST

Patent Literature

Patent Literature 1: JP2015-500697A

SUMMARY OF INVENTION

Technical Problem

The ball portion into which a liquid is poured, the plate for supporting the container, and a stem connecting the ball portion and the plate are integrally formed. Therefore, a certain amount of space is required to store the container. In addition, it is not easy to handle the wine glass when carrying the same. In the wine glass disclosed in Patent Literature 1, it is disclosed that a ball portion and the stem are detachable, and the detached stem can be stored in a storage portion (ball portion) using a magnet. However, in this wine glass as well, since the storage portion has a certain volume, when the stem is stored in the storage portion, it is necessary to secure a certain amount of space. In addition, the stem and the storage portion (ball portion), which are attached and detached using a magnet and stored, easily fall off due to vibration. Therefore, it is not easy to handle only the ball portion and the stem which are constituent members.

It is demanded to provide a glass container such as a wine glass that can store a predetermined volume of liquid when pouring the liquid into the wine glass. When storing or carrying the container, a bowl portion can be disassembled and assembled so that the container has a size equal to or smaller than a predetermined size, and constituent members do not fall off even when the container is transported.

Solution to Problem

According to the present invention, there is provided an assembleable container including an upper main body having a first connector and a lower main body having a second connector to be coupled to the first connector of the upper main body. The upper main body and the lower main body are configured to be assembled and/or disassembled using the first connector and the second connector. The first connector has a convex portion or a concave portion formed on an outer periphery of the upper main body, the second connector has a concave portion or a convex portion that is formed on an inner periphery of the lower main body and can fit into the convex portion or the concave portion of the first connector, and the first connector and the second connector are configured such that concave and convex portions thereof fit together.

When the first connector and the second connector are coupled, a bottom surface of the first connector and a bottom surface of the second connector are disposed facing each other. Further, the first connector and the second connector are coupled so as to provide a leakage prevention portion for preventing the liquid from leaking.

The assembleable container according to the present invention includes the upper main body having the first connector and the lower main body having the second connector to be coupled to the first connector of the upper main body, and the upper main body and the lower main body are configured to be assembled and/or disassembled using the first connector and the second connector. Therefore, when pouring a liquid such as wine into the assembleable container, a predetermined amount of the liquid can be stored in the assembleable container. Further, when carrying the assembleable container or storing the assembleable container on a shelf or the like. since the upper main body and the lower main body can be separated, the assembleable container can be easily carried or stored without taking up space. When the first connector and the second connector are coupled, a bottom surface of the first connector and a bottom surface of the second connector are disposed facing each other. At this time, the leakage prevention portion for preventing a liquid from leaking is provided between the first connector and the second connector. Therefore, even when the assembleable container is inclined, it is possible to prevent a liquid from leaking to the outside of the assembleable container from a connecting portion between the upper main body and the lower main body.

In the assembleable container according to the present invention, a cavity may be formed between the convex portion and the concave portion, and the cavity may forms the leakage prevention portion.

In the assembleable container according to the present invention, a cavity is formed between the convex portion and the concave portion, and the cavity can block and hold the flow of a liquid. Therefore, the liquid can be effectively prevented from leaking to the outside between an outer peripheral surface of the first connector and an inner peripheral surface of the second connector.

In the assembleable container according to the present invention, a size increases from an upper side toward a lower side of an inner peripheral side of the lower main body.

In the assembleable container according to the present invention, the concave portion becomes larger from the upper side toward the lower side of the inner peripheral side of the lower main body. When the first connector and the second connector are disposed facing each other, the cavity between the concave portion on the inner peripheral side of the lower main body and the convex portion of the upper main body also becomes larger on a lower side of the second connector, and thus a larger amount of liquid can be stored in the cavity.

In the assembleable container according to the present invention, the bottom surface of the first connector has a first water stop portion having a convex or concave shape, and the bottom surface of the second connector has a second water stop portion having a concave or convex shape corresponding to the shape of the first water stop portion. A convex or concave shape of the second water stop portion may have a tapered shape whose width decreases toward a tip direction, and when the bottom surface of the first connector and the bottom surface of the second connector are disposed facing each other, the first water stop portion and the second water stop portion are disposed facing each other and form the leakage prevention portion.

In the assembleable container according to the present invention, the bottom surface of the first connector has the first water stop portion, and the bottom surface of the second connector has the second water stop portion.

When the first connector and the second connector are coupled, a cavity formed between a first connector bottom surface and a second connector bottom surface is extended as compared with a case where the cavity is formed substantially horizontally. By extending the cavity, when a liquid is poured into the assembleable container and inclined, it is possible to effectively reduce the amount of the liquid flowing out of the assembleable container from the cavity. By disposing the first water stop portion and the second water stop portion facing each other, it is possible to block the cavity and effectively prevent the liquid from leaking to the outside of the assembleable container from the cavity. Since the shape of the second water stop portion has a tapered shape whose width decreases toward a tip, when the first connector and the second connector are assembled, a length of a cavity between the second water stop portion and the first water stop portion is extended as compared with a case where the cavity is provided substantially perpendicularly, and when a liquid is poured into the assembleable container and inclined, the movement of the liquid to the outside of the cavity can be effectively reduced. By disposing the second water stop portion and the first water stop portion facing each other to form a contact portion, it is possible to block the cavity and effectively prevent the liquid from leaking to the outside of the assembleable container from the cavity.

In the assembleable container according to the present invention, the second water stop portion may have a water storage portion having a concave shape, and when the first water stop portion and the second water stop portion are disposed facing each other, a space for holding a liquid in the water storage portion may be formed therein, and the water storage portion may function as the leakage prevention portion.

In the assembleable container according to the present invention, even if a liquid is present between the first water stop portion and the second water stop portion of the assembleable container after assembly, it is possible to effectively prevent a liquid from moving and leaking to the outside of the assembleable container due to capillary action caused by the formation of a space in the water storage portion when the first water stop portion and the second water stop portion are disposed facing each other. In addition, by standing the assembleable container upright, the liquid can move downward in the space and can be stored in the water storage portion.

In the assembleable container according to the present invention, the bottom surface of the second connector may have an inclined surface inclined downward toward an inner side in a radial direction.

In the assembleable container according to the present invention, since the bottom surface is formed to be inclined downward toward the inside in the radial direction, when the first connector and the second connector are assembled, the bottom surface of the first connector and the bottom surface of the second connector are extended compared with a case where the bottom surface is formed to be substantially horizontal, and thus when a liquid is poured into the assembleable container and inclined, it is possible to effectively reduce the amount of the liquid flowing out of the cavity. Even when the liquid moves into the cavity. the inclined surface is inclined upward as the liquid moves outward in a radial direction of the cavity, compared with a case where the cavity is formed substantially horizontally, and thus it is possible to effectively prevent the liquid from leaking out of the cavity. Further, when the liquid is present in the cavity, by standing the assembleable container upright, the liquid can move toward the inner side in the radial direction of the cavity along the inclined surface and return to the liquid storage portion.

In the assembleable container according to the present invention, the bottom surface of the second connector may have a step portion extending in a circumferential direction, the bottom surface of the first connector may have a step portion extending in a circumferential direction, and when the first connector and the second connector are disposed facing each other, the step portion on the bottom surface of the second connector and the step portion on the bottom surface of the first connector face each other and function as the leakage prevention portion.

In the assembleable container according to the present invention, since the step portion extending in the circumferential direction is formed in the bottom surface of the second connector, in a case where the first connector and the second connector are assembled, even when a liquid enters a slight gap between the bottom surface of the second connector and the bottom surface of the first connector facing each other, the step portion of the bottom surface of the second connector serves as a wall and can prevent the liquid from leaking into the cavity or outside. The step portion provided on the bottom surface of the second connector and the step portion provided on the bottom surface of the first connector face each other and partially come into contact with each other, thereby forming a wall. The wall can block the flow of the liquid to the outside of the assembleable container.

In the assembleable container according to the present invention, the upper main body may be separated from the lower main body and stored in the lower main body, and when storing the upper main body in the lower main body, the upper main body may be configured to be couped to the lower main body by inserting the first connector upside down through an opening of the lower main body, and fitting the convex portion or the concave portion of the first connector into the convex portion or the concave portion of the second connector.

In the assembleable container according to the present invention, the upper main body is configured to be separated from the lower main body and stored in the lower main body, and when storing the upper main body in the lower main body, the upper main body is configured to be stored in the lower main body by inserting the first connector upside down through the opening of the lower main body, thereby reducing the required storage space. Since the convex portion or the concave portion of the first connector is configured to be fitted into the convex portion or the concave portion of the second connector, by fixing the first connector and the second connector, the lower main body and the upper main body can be fixed.

In the assembleable container according to the present invention, the lower main body has a leg receiving portion on an outer peripheral bottom surface and further includes a leg detachably provided on the leg receiving portion of the lower main body, and the leg is configured to be separated from the lower main body and stored in the lower main body. The leg includes a stem to be attached to and detached from the lower main body, and a plate connected to the stem. When storing the leg in the lower main body, by inserting the leg upside down through the opening of the lower main body and fitting the leg into the concave portion or the convex portion of the second connector, the leg is configured to be coupled to the lower main body.

The assembleable container according to the present invention further includes the leg detachably provided on the leg receiving portion of the lower main body, and the leg includes the stem to be attached to and detached from the lower main body and the plate connected to the stem. When storing the leg in the lower main body, the leg is configured to be inserted upside down through the opening of the lower main body, thereby reducing the required storage space. Since the convex portion or the concave portion provided on the plate of the leg may be fitted into the convex portion or the concave portion of the second connector, the leg can be fixed to the lower main body.

In the assembleable container according to the present invention, the leg has a second connecting portion having a protruding shape at a side of a bottom surface of the plate. When the leg is stored in the lower main body, the lower main body may be connectable in multiple stages by coupling the second connecting portion of the leg to the leg receiving portion of the lower main body.

In the assembleable container according to the present invention, since the leg has the second connecting portion having a protruding shape at the side of the bottom surface of the plate, when the leg is stored in the lower main body, the leg receiving portion of the lower main body can be coupled to the second connecting portion of the leg and the lower main body can be coupled in multiple stages, and thus the assembleable container can be stacked vertically, reducing a space for storing the assembleable container in a cupboard, a backpack, and the like.

In the assembleable container according to the present invention, the lower main body may be coupled in multiple stages when the upper main body is stored in the lower main body.

In the assembleable container according to the present invention, since the lower main body can be coupled in multiple stages when the upper main body is stored in the lower main body, the upper main body, the lower main body, and the leg can be connected in multiple stages in a collective form, and a space for storing the assembleable container in a cupboard, a backpack, and the like can be reduced.

Advantageous Effects of Invention

The assembleable container according to the present invention includes the upper main body having the first connector and the lower main body having the second connector to be coupled to the first connector of the upper main body, and the upper main body and the lower main body can be assembled and/or disassembled using the first connector and the second connector. Therefore. when pouring a liquid such as wine into the assembleable container, the upper main body and the lower main body can be coupled to store a predetermined amount of liquid.

Further, when carrying the assembleable container or storing the assembleable container on a shelf or the like, since the upper main body and the lower main body can be separated, the assembleable container can be easily carried or stored without taking up space.

In addition, when a coupling portion of the first connector is coupled to a coupling portion of the second connector, the bottom surface of the first connector and the bottom surface of the second connector are disposed facing each other, and a leakage prevention portion is provided for preventing a liquid from leaking.

BRIEF DESCRIPTION OF DRAWINGS

FIG. 1 is also a diagram schematically showing a perspective view of the container.

FIG. 1 is also a diagram schematically showing a perspective view of the container.

DESCRIPTION OF EMBODIMENTS

Figure 1:
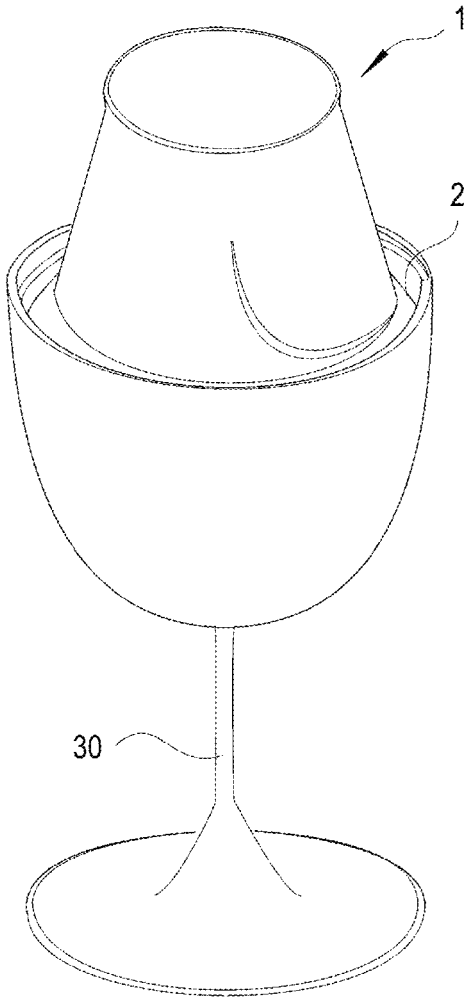
FIG. 1 is a diagram schematically illustrating an assembleable container according to a first embodiment.

Hereinafter, embodiments of an assembleable container according to the present invention will be described in detail with reference to the drawings. In the description of the drawings, the same elements are denoted by the same reference numerals, and redundant description thereof will be omitted. In the description, terms indicating directions such as "up" and "down" are terms of convenience based on states shown in the drawings.

First Embodiment

The container according to the present embodiment is a container that can be freely assembled, disassembled, and stored. First, an assembleable container 1 that is assembled will be described in detail below.

Container Assembled

Figure 2:
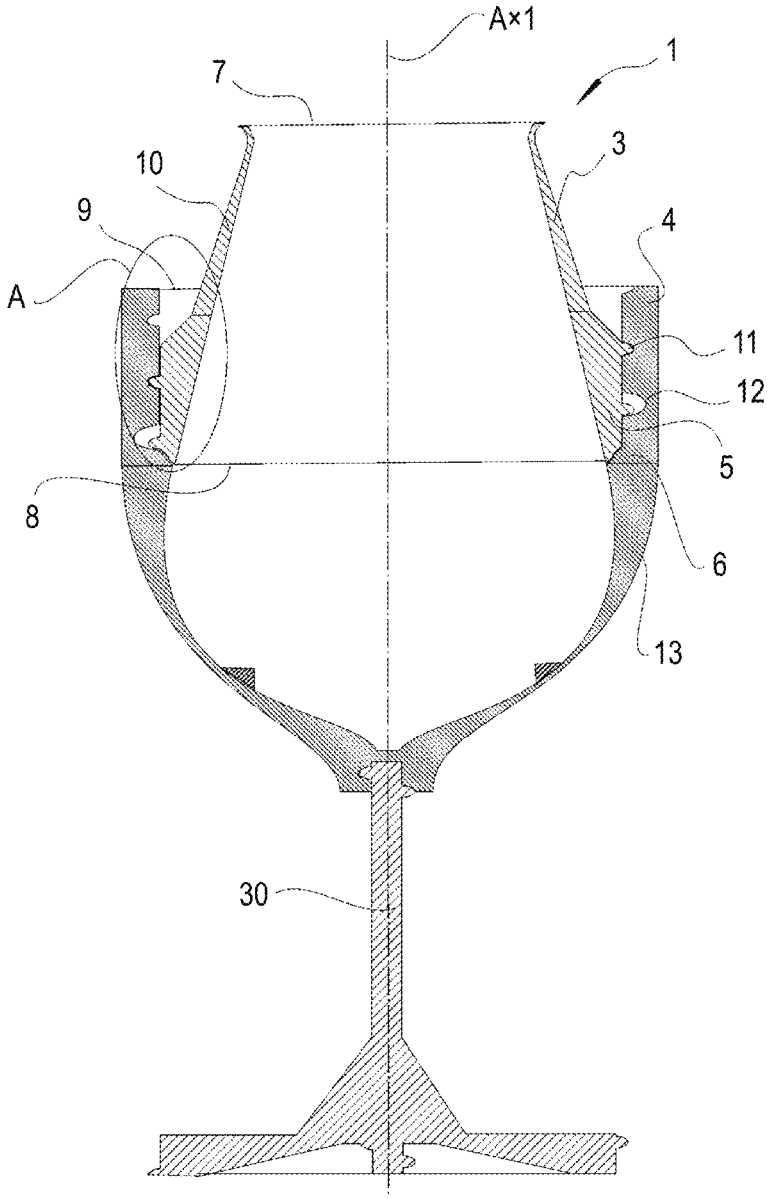
FIG. 2 is a diagram schematically showing a cross-sectional view of the assembleable container according to the first embodiment when the assembleable container is assembled.

FIG. 1 is a diagram schematically illustrating the assembleable container 1 according to a first embodiment. FIG. 1 is a perspective view of the assembleable container 1. FIG. 2 is a cross-sectional view of the assembleable container 1 in FIG. 1. FIG. 2 shows a central axis A×1 of the assembleable container 1.

In FIG. 1, the assembleable container 1 may include a container main body 2 and a leg 30 which are disposed in this order in an extending direction of the central axis A×1.

As shown in FIG. 2, the container main body 2 may include an upper main body 3 having a first connector 5 and a lower main body 4 having a second connector 6 coupled to the first connector 5 of the upper main body 3.

The upper main body 3 and the lower main body 4 of the container main body 2 can be assembled and disassembled using the first connector 5 and the second connector 6.

In the present embodiment, the first connector 5 of the upper main body 3 and the second connector 6 of the lower main body 4 are provided so as to be directly coupled without using a cushion member such as a packing.

The upper main body 3 of the assembleable container I has a substantially circular first opening 7. When pouring a liquid 14 such as water, alcohol, wine, or the like into the assembleable container 1, the upper main body 3 and the lower main body 4 are coupled to form the container main body 2, and a predetermined amount of liquid can be stored through the first opening 7.

The upper main body 3 has a substantially circular second opening 8 at a side on which the upper main body 3 is coupled to the lower main body 4. In the present embodiment, the upper main body 3 may have, for example, a substantially truncated cone shape in which the second opening 8 has a larger diameter than the first opening 7. However, the shape of the upper main body 3 is not limited thereto, and may be, for example, a substantially cylindrical shape.

The lower main body 4 can be assembled with and disassembled from the upper main body 3 and stored in the upper main body 3 by connecting the second connector 6 to the first connector 5 of the upper main body 3. The lower main body 4 may have a substantially circular third opening 9 at a side on which the lower main body 4 is connected to the upper main body 3

As shown in FIG. 2, the central axis A×1 passes through substantially the center of the first opening 7, the second opening 8, and the third opening 9 each having a substantially circular shape. The first opening 7, the third opening 9, and the second opening 8 are disposed in this order from the top of FIG. 2.

The upper main body 3, the lower main body 4, and the leg 30 provided in the assembleable container 1 can be made of, for example, glass, a resin such as plastic, stone such as ceramics, a metal such as aluminum, copper, and stainless steel, or wood such as cedar. In the present embodiment, the upper main body 3, the lower main body 4, and the leg 30 are made of glass.

Next, the upper main body 3 will be described with reference to FIG. 2. As shown in FIG. 2, the upper main body 3 may include a tubular portion 10 and the first connector 5. The first opening 7 is provided at one end of the tubular portion 10.

On the other hand, the first connector 5 is provided at the other end of the tubular portion 10. The first connector 5 is fitted into the second connector 6 of the lower main body 4 so that the upper main body 3 can be attached to the lower main body 4. At this time, the second opening 8 of the first connector 5 faces the lower main body 4, and at least a part of the second opening 8 is in contact with the lower main body 4.

The first connector 5 may have a first coupling convex portion 11 formed on an outer periphery of the upper main body 3. The second connector 6 is provided with a coupling concave portion 12 on an inner periphery thereof, and the coupling concave portion 12 can be fitted into the first coupling convex portion 11.

In the present embodiment, the first coupling convex portion 11 is formed in substantially two stages in a spiral shape along the entire outer periphery of the first connector 5, and can function as a male thread by being fitted into the coupling concave portion 12 of the second connector 6.

As will be described in detail later, when the first coupling convex portion 11 of the upper main body 3 is coupled to the coupling concave portion 12 of the lower main body 4, a cavity 20 is formed between the first coupling convex portion 11 and the coupling concave portion 12.

Next, the lower main body 4 coupled to the upper main body 3 will be described. As shown in FIG. 2, the lower main body 4 may have a liquid storage portion 13 and the second connector 6 for fitting the first connector 5 of the upper main body 3. The third opening 9 is provided at one end of the second connector 6.

On the other hand, the liquid storage portion 13 is provided at the other end of the second connector 6. The liquid storage portion 13 can store the liquid 14 such as water, alcohol, or wine poured from the first opening 7 in a bottom portion of the liquid storage portion 13.

In the present embodiment, the liquid storage portion 13 is provided in a bowl shape. However, the shape of the liquid storage portion 13 is not limited to the bowl shape, and may be, for example, a polygonal body such as an octahedron, an elliptical shape, or the like.

The second connector 6 of the lower main body 4 has, on the inner periphery thereof, the coupling concave portion 12 for fitting to the first coupling convex portion 11 of the first connector 5. The coupling concave portion 12 can be formed along the entire inner periphery of the second connector 6 corresponding to the shape of the first coupling convex portion 11 so as to be fitted into the first coupling convex portion 11. In the present embodiment. the coupling concave portion 12 is provided as a female thread into which the first coupling convex portion 11 of the first connector 5 can be fitted.

As will be described in detail later, in the assembleable container 1, the upper main body 3 is coupled to the lower main body 4 to form an integrated container, and can also be separated from the lower main body 4. The separated upper main body 3 can be stored in the lower main body 4.

When carrying the assembleable container 1 or storing the assembleable container 1 on a shelf or the like, since the upper main body 3 and the lower main body 4 can be separated, the assembleable container 1 can be easily stored without taking up space.

Further, the leg 30 detachably connected and fixed to the lower main body 4 can also be separated from the lower main body 4. The leg 30 can also be stored in the lower main body 4 when the upper main body 3 is stored in the lower main body 4.

When storing the upper main body 3 and the leg 30 in the lower main body 4, the coupling concave portion 12 can be used for coupling and fixing the lower main body 4. To store the upper main body 3 and the leg 30 using the coupling concave portion 12, in the present embodiment, a length (stage) of a groove of the coupling concave portion 12 is longer than a length at which the first coupling convex portion 11 is coupled.

Figure 3:
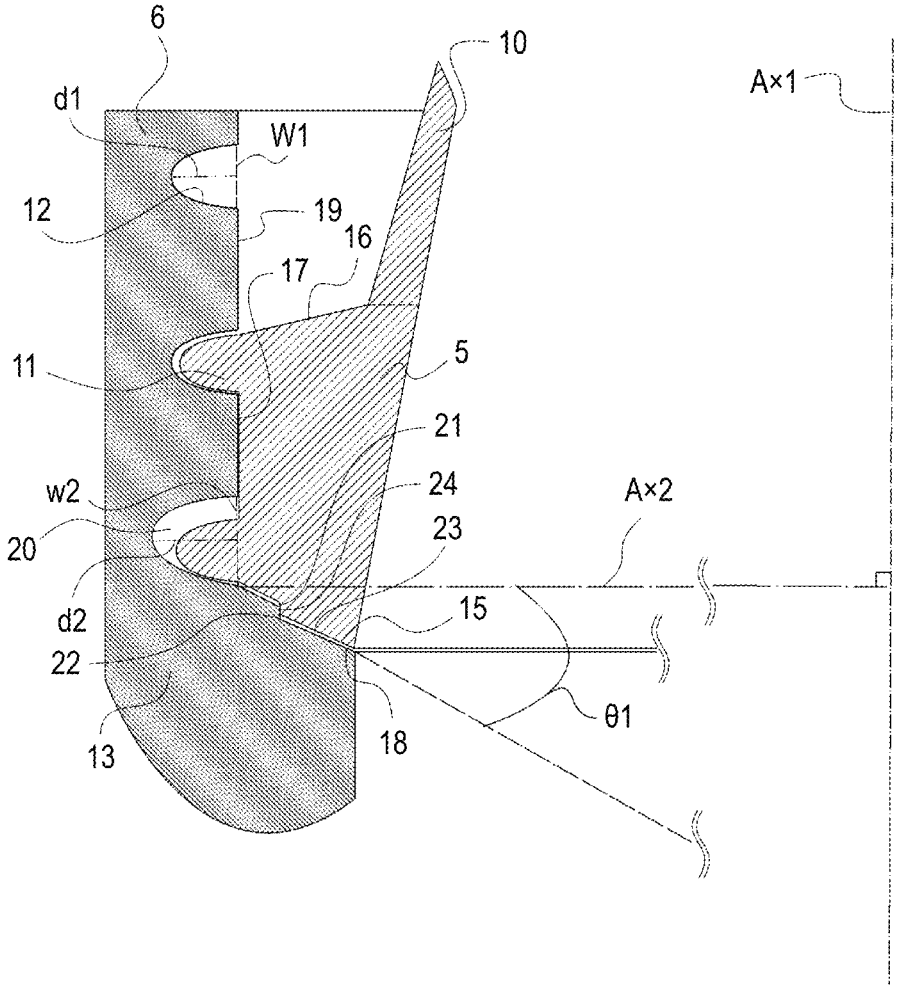
FIG. 3 is an enlarged schematic diagram of a portion A in FIG. 2.

Next, structures of the first connector 5 and the second connector 6 will be described in detail with reference to FIG. 3. FIG. 3 is an enlarged schematic diagram of a portion A in FIG. 2. FIG. 3 shows the central axis A×1 and a horizontal axis Ax2 orthogonal to the central axis A×1.

First, the first connector 5 will be described. As shown in FIG. 3, the first connector 5 is provided on a lower side of the tubular portion 10 of the upper main body 3. The first connector 5 includes a first connector bottom surface 15, a first connector upper surface 16, and a first connector outer peripheral surface 17. In the present embodiment, the first connector outer peripheral surface 17 is provided substantially parallel to the extending direction of the central axis A×1.

In the present embodiment, the first connector outer peripheral surface 17 is provided with the first coupling convex portion 11 that is continuously formed in a spiral shape. The first coupling convex portion 11 is a convex portion used for coupling to the second connector 6. The first coupling convex portion 11 is spirally provided over two turns (two stages) on an outer peripheral surface of the first connector 5. However, the shape of the first coupling convex portion 11 is not limited thereto, and may be, for example, one or a plurality of islands as long as the first connector outer peripheral surface 17 of the upper main body 3 and a second connector inner peripheral surface 19 of the lower main body 4 can be fixed.

When the upper main body 3 and the lower main body 4 are assembled, the first connector bottom surface 15, which is a lower side of the first connector outer peripheral surface 17, faces a second connector bottom surface 18 provided in the second connector 6 and can at least partially come into contact with the second connector bottom surface 18, corresponding to a shape of the second connector bottom surface 18.

On the other hand, when the upper main body 3 and the lower main body 4 are separated and the upper main body 3 is stored in the lower main body 4, the first connector upper surface 16, which is an upper side of the first connector outer peripheral surface 17, faces the second connector bottom surface 18 of the lower main body 4 and can at least partially come into contact with the second connector bottom surface 18.

As described above, in the assembleable container 1, the upper main body 3 can be separated and disassembled from the lower main body 4, and the upper main body 3 can be stored in the lower main body 4. When the upper main body 3 and the lower main body 4 are separated and the upper main body 3 is stored in the lower main body 4, the first connector upper surface 16 and the second connector bottom surface 18 face each other. At this time, at least a part of the first connector upper surface 16 comes into contact with the second connector bottom surface 18, and the upper main body 3 can be stably stored in the lower main body 4.

Next, the second connector 6 of the lower main body 4, which faces the first connector 5 of the upper main body 3 and has a part that can come into contact with the first connector 5, will be described in detail.

As shown in FIG. 3, the second connector 6 has the second connector bottom surface 18 and the second connector inner peripheral surface 19.

First, the second connector inner peripheral surface 19 is provided corresponding a shape of the first connector outer peripheral surface 17 so as to be able to face the first connector outer peripheral surface 17 when the first connector 5 and the second connector 6 are connected.

In the present embodiment, the second connector inner peripheral surface 19 corresponds to the first connector outer peripheral surface 17 and is provided substantially parallel to the extending direction of the central axis A×1. The second connector inner peripheral surface 19 is provided with the coupling concave portion 12 configured to allow the first coupling convex portion 11 to be coupled thereto.

In the present embodiment, the coupling concave portion 12 is provided in a spiral shape so as to correspond to the shape of the first coupling convex portion 11 and to be fitted thereto.

The second connector bottom surface 18 extends from a lower side of the second connector inner peripheral surface 19 to the liquid storage portion 13. The coupling concave portion 12 provided in the second connector inner peripheral surface 19 can be provided such that one end thereof is positioned near the second connector bottom surface 18.

Referring to FIG. 3, the horizontal axis A×2 orthogonal to the central axis A×1 is shown, and the second connector bottom surface 18 of the second connector 6 is inclined downward by an angle θ1 with respect to the horizontal axis A×2.

The angle θ1 is an average of angles formed by the horizontal axis A×2 and the second connector bottom surface 18 provided over the entire periphery of the second connector connector 6, and can be set to, for example, a range of 15 degrees to 60 degrees.

In the present embodiment, the second connector bottom surface 18 is provided in a substantially planar shape. However, the shape of the second connector bottom surface 18 is not limited thereto, and may be, for example, a shape curved from the outer periphery toward the inside in the radial direction, or a corrugated shape with repeated irregularities.

When the upper main body 3 and the lower main body 4 are assembled, in the first connector 5 and the second connector 6, the first connector outer peripheral surface 17 and the second connector inner peripheral surface 19 face each other over the entire periphery and can at least partially come into contact with each other, and the first connector bottom surface 15 and the second connector bottom surface 18 face each other over the entire periphery and can at least partially come into contact with each other.

In addition, when the upper main body 3 and the lower main body 4 are assembled, one end of the first connector outer peripheral surface 17 and the second connector inner peripheral surface 19 facing each other is connected to the outside of the assembleable container 1, and the other end is connected to a facing portion of the first connector bottom surface 15 and the second connector bottom surface 18.

Further, the other end of the facing portion of the first connector bottom surface 15 and the second connector bottom surface 18 is connected to the liquid storage portion 13.

Therefore, when the upper main body 3 and the lower main body 4 are assembled, a gap from the liquid storage portion 13 to the outside of the assembleable container 1 is formed between the facing portion of the first connector 5 and the second connector 6.

To prevent the liquid 14 from leaking to the outside through the gap, the assembleable container 1 is provided with several leakage prevention portions for preventing the leakage of the liquid 14 by coupling the first connector 6 and the second connector 7.

Next, the cavity 20 formed between the first coupling convex portion 11 provided on the first connector outer peripheral surface 17 and the coupling concave portion 12 provided on the second connector inner peripheral surface 19 will be described with reference to FIG. 3.

As shown in FIG. 3, the first coupling convex portion 11 is provided as a convex protruding portion that can be fitted into the coupling concave portion 12. In the present embodiment, a shape of the protruding portion of the first coupling convex portion 11 can be substantially the same from an upper end to a lower end of the first coupling convex portion 11.

The second connector 6 of the lower main body 4 is provided with the second connector inner peripheral surface 19 on an inner peripheral surface thereof, and the second connector inner peripheral surface 19 is provided with the corresponding coupling concave portion 12 that can be fitted into the first coupling convex portion 11 of the first connector 5.

When the upper main body 3 and the lower main body 4 are assembled and the first coupling convex portion 11 of the first connector 4 is coupled to the coupling concave portion 12 of the second connector 6, the cavity 20 is formed between the first coupling convex portion 11 and the coupling concave portion 12.

When the first connector 5 and the second connector 6 are coupled, it is difficult to make the first connector bottom surface 15 of the first connector 5 and the second connector bottom surface 18 of the second connector 6 which are disposed facing each other, and the first connector outer peripheral surface 17 and the second connector inner peripheral surface 19 which are disposed facing each other, come into contact with each other over the entire surface, and slight gaps are formed therebetween.

When drinking the liquid 14 using the assembleable container 1, the assembleable container 1 is inclined, and the liquid 14 may reach the first connector outer peripheral surface 17 and the second connector inner peripheral surface 19 through the gap between the first connector bottom surface 15 and the second connector bottom surface 18, and may further leak to the outside.

However, even if the liquid 14 reaches a facing portion of the first connector outer peripheral surface 17 and the second connector inner peripheral surface 19 through the slight gap between the first connector bottom surface 15 and the second connector bottom surface 18, by fitting the first coupling convex portion 11 and the coupling concave portion 12, the cavity 20, which is a fitting portion between the first coupling convex portion 11 and the coupling concave portion 12 facing each other, can block and hold the flow of the advancing liquid 14. Therefore, the cavity 20 functions as a leakage prevention portion, and can prevent the liquid 14 from leaking to the outside of the assembleable container 1 between the first connector outer peripheral surface 17 and the second connector inner peripheral surface 19.

Even if the liquid 14 is present between the first connector outer peripheral surface 17 and the second connector inner peripheral surface 19, by standing the assembleable container 1 upright, the liquid 14 remaining between the first connector outer peripheral surface 17 and the second connector inner peripheral surface 19 descends along the cavity 20 and can be accumulated in a bottom portion of the cavity 20.

The liquid 14 accumulated in the bottom portion of the cavity 20 can also be returned to the liquid storage portion 13 by slightly loosening the coupling between the lower main body 4 and the upper main body 3 of the assembleable container 1 and inclining the assembleable container 1.

In the present embodiment, the first coupling convex portion 11 is provided in a convex shape. However, the first coupling convex portion 11 is not limited thereto, and may be provided in a concave shape. When the first coupling convex portion 11 is provided in a concave shape, by providing the coupling concave portion 12 in a convex shape such that the first coupling convex portion 11 and the coupling concave portion 12 correspond to each other, the first coupling convex portion 11 and the coupling concave portion 12 can also be fitted.

Next, a shape of the cavity 20 will be described with reference to FIG. 3. First, in the present embodiment, the coupling concave portion 12 constituting the cavity 20 may have a concave shape in which a radial depth and a vertical width increase as the coupling concave portion 12 extends from an upper end of the second connector inner peripheral surface 19 near the third opening 9 toward a lower end of the second connector inner peripheral surface 19 near the liquid storage portion 13.

A vertical width W of the coupling concave portion 12 may change from W1 to W2, which has a value larger than W1, from an upper side to a lower side of the coupling concave portion 12.

On the other hand, a radial depth d of the coupling concave portion 12 may change from d1 to d2, which has a value larger than d1, from the upper side to the lower side of the coupling concave portion 12.

Values of the width W and the depth d of the coupling concave portion 12 gradually change from the upper side to the lower side of the coupling concave portion 12. However, it is not necessary to gradually change the values of W and d of the coupling concave portion 12, and the values may be changed in stages.

Since the values of the width W and the depth d of the coupling concave portion 12 gradually change from the upper side to the lower side of the coupling concave portion 12, a size of the cavity 20 also gradually increases from the upper side to the lower side of the coupling concave portion 12.

Since the cavity 20 is larger on a lower side of the second connector 6, a larger amount of the liquid 14 entering between the first connector 5 and the second connector 6 can be accumulated in the bottom portion of the cavity 20.

In the present embodiment, since a bottom surface of the first coupling convex portion 11 and a bottom surface of the coupling concave portion 12 are designed to be in contact with each other, the cavity 20 is formed above the first coupling convex portion 11.

Next, referring to FIG. 3 again, the first connector bottom surface 15 and the second connector bottom surface 18, which are disposed facing each other when the first connector 5 and the second connector 6 are coupled, will be described.

Referring to FIG. 3, the second connector bottom surface 18 of the second connector 6 may have an inclined surface 23 that is inclined downward toward the inside in the radial direction by the angle θ1 with respect to the horizontal axis A×2.

In addition, the first connector bottom surface 15, which corresponds to the second connector bottom surface 18 and is provided so as to be at least partially in contact with the second connector bottom surface 18, is disposed facing the second connector bottom surface 18 when the upper main body 3 and the lower main body 4 are assembled.

In the present embodiment, the first connector bottom surface 15 and the second connector bottom surface 18 are inclined downward by the angle θ1 with respect to the horizontal axis A×2 and are disposed facing each other.

Since the second connector bottom surface 18 has the inclined surface 23 that is inclined downward by the angle θ1 with respect to the horizontal axis A×2, when drinking the liquid 14, even if the liquid 14 enters the slight gap between the first connector bottom surface 15 and the second connector bottom surface 18, the inclined surface 23 of the second connector bottom surface 18 functions as a leakage prevention portion that resists a movement direction of the liquid 14, and can effectively prevent the liquid 14 from entering the cavity 20 by serving as an upward slope.

When the liquid 14 is accumulated in the cavity 20 of the assembleable container 1 that is assembled, by standing the assembleable container 1 upright, the liquid 14 can flow along the inclined surface 23 following a downward slope of the inclined surface 23, and can return to the liquid storage portion 13.

Next, referring to FIG. 3, a second connector bottom surface step portion 22 (a second step portion) is formed on the second connector bottom surface 18. Hereinafter, the second connector bottom surface step portion 22 will be described.

First, the second connector bottom surface step portion 22 is provided on the second connector bottom surface 18 as a recess (concave portion) extending in a circumferential direction of the second connector 6.

In the present embodiment, the second connector bottom surface step portion 22 is provided in a linear cutout shape in the second connector bottom surface 18. However, the second connector bottom surface step portion 22 is not limited thereto, and may be provided in a curved shape, for example.

A size of the step of the second connector bottom surface step portion 22 may be, for example, about 0.1 mm or more and less than 3 mm.

Since the second connector bottom surface step portion 22 is provided on the second connector bottom surface 18, when drinking the liquid 14 using the assembleable container 1, even if the liquid 14 enters the slight gap between the first connector bottom surface 15 and the second connector bottom surface 18, the second connector bottom surface step portion 22 functions as a leakage prevention portion with respect to the movement direction of the liquid 14, and can effectively prevent the liquid 14 from entering the cavity 20 by serving as an upward slope steeper than the inclined surface 23.

Next, referring to FIG. 3, the first connector bottom surface 15 is also provided with a first connector bottom surface step portion 21 (a first step portion) corresponding to the second connector bottom surface step portion 22 provided on the inclined surface 23 of the second connector bottom surface 18. The first connector bottom surface step portion 21 faces the second connector bottom surface step portion 22 and is provided such that at least a part thereof can be in contact with the second connector bottom surface step portion 22.

When the upper main body 3 and the lower main body 4 are assembled, since the second connector bottom surface step portion 22 of the second connector bottom surface 18 and the first connector bottom surface step portion 21 of the first connector bottom surface 15 face each other, a wall 24 can be formed at a facing portion of the first connector bottom surface step portion 21 and the second connector bottom surface step portion 22.

Since the wall 24 is formed in the facing portion between the second connector bottom surface step portion 22 and the first connector bottom surface step portion 21, it is possible to block the flow of the liquid 14 to the outside of the assembleable container 1. Therefore, the wall 24 functions as a leakage prevention portion, and can effectively prevent the liquid 14 from passing through the gap between the first connector bottom surface 15 and the second connector bottom surface 18 to the outside of the assembleable container 1.

In the present embodiment, one second connector bottom surface step portion 22 is provided on the second connector bottom surface 18. The first connector bottom surface step portion 21 of the first connector bottom surface 15 is also provided with one stage corresponding to the second connector bottom surface step portion 22, and the first connector bottom surface step portion 21 and the second connector bottom surface step portion 22 face each other to form the one-stage wall 24.

However, the wall 24 is not necessarily one stage, and a plurality of walls 24 can be provided by providing a plurality of second connector bottom surface step portions 22 in a radial direction.

By providing a plurality of walls 24, the second connector bottom surface step portion 22 and the first connector bottom surface step portion 21 are provided with contact portions in multiple stages, and it is possible to effectively prevent the liquid 14 from entering the cavity 20.

Figure 4:
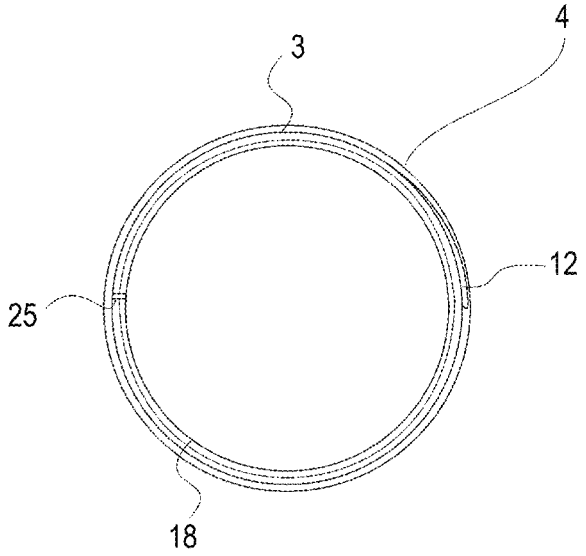
FIG. 4 is a top view schematically showing a lower main body of the assembleable container according to the first embodiment.

Next, a second connector groove 25 provided in the second connector bottom surface 18 of the second connector 6 will be described with reference to FIG. 4. The second connector groove 25 is a groove-shaped concave portion provided in the second connector bottom surface 18.

The second connector groove 25 is provided extending from a lower end of the coupling concave portion 12 to the second connector bottom surface 18 in a radial direction.

By providing the second connector groove 25, when assembling the upper main body 3 and the lower main body 4 to drink the liquid 14, for example, even if the liquid 14 enters the cavity 20, the liquid 14 can descend through the second connector groove 25 according to an angle of the inclined surface 23 of the second connector bottom surface 18 and can automatically return to the liquid storage portion 13 by standing the assembleable container 1 upright.

Container Disassembled and Stored

The upper main body 3 of the assembleable container 1 is coupled to the lower main body 4 to form an integrated container, and can also be separated from the lower main body 4. The leg 30 detachably connected and fixed to the lower main body 4 can also be separated from the lower main body 4.

Further, the upper main body 3 can be separated from the lower main body 4 and stored in the lower main body 4.

The leg 30 can also be stored in the lower main body 4 when the upper main body 3 is stored in the lower main body 4. Hereinafter, a state in which the upper main body 3, the lower main body 4, and the leg 30 of the assembleable container 1 are disassembled, and the upper main body 3 and the leg 30 are stored in the lower main body 4 will be described.

Figure 5:
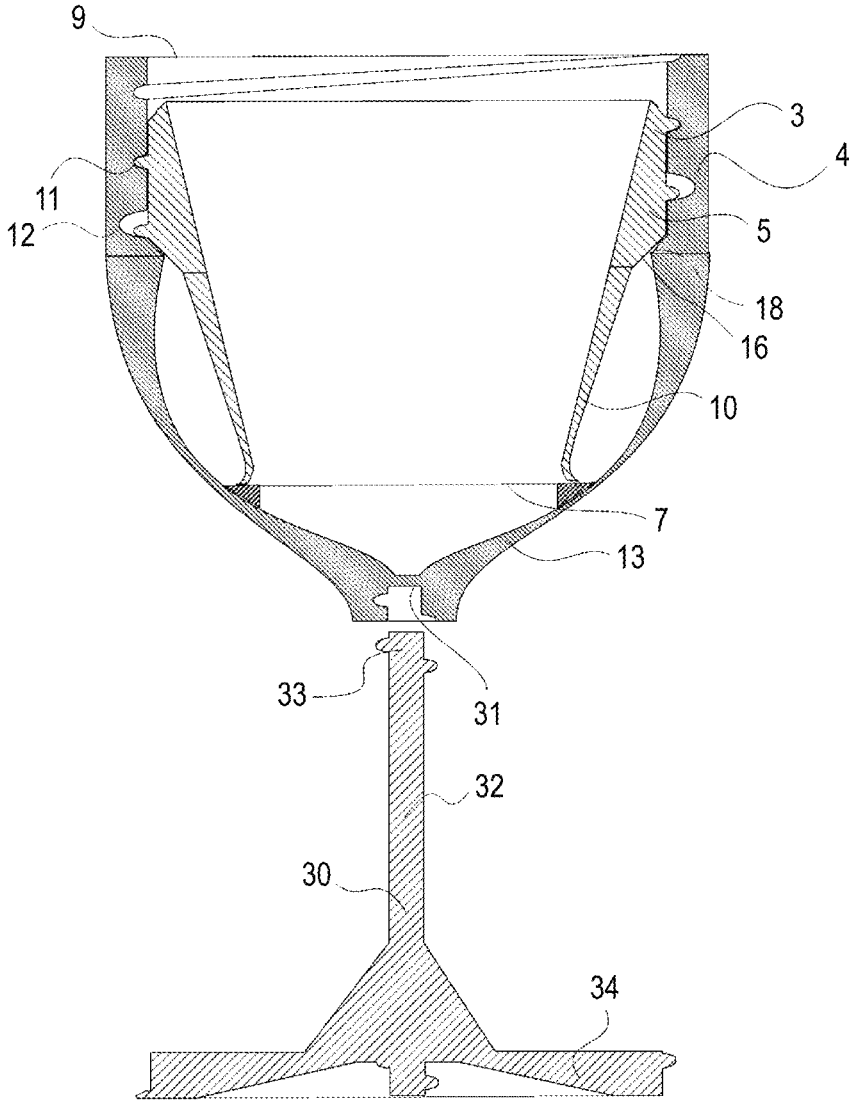
FIG. 5 is a diagram schematically illustrating a state in which the assembleable container according to the first embodiment is disassembled, and an upper main body is stored in the lower main body.

FIG. 5 is a diagram illustrating a state in which the upper main body 3 is stored and fixed to the lower main body 4. In FIG. 5, the leg 30 is shown in a disassembled state.

As shown in FIG. 5, when storing the upper main body 3 in the lower main body 4, the first connector 5 is inserted upside down through the third opening 9 of the lower main body 4, and the first coupling convex portion 11 of the first connector 5 is fitted into the coupling concave portion 12 of the second connector 6, thereby reducing the required storage space.

When storing the upper main body 3 in the lower main body 4, the first connector upper surface 16 of the first connector 5 and the second connector bottom surface 18 of the upper main body 3 face each other and can at least partially come into contact with each other, and the upper main body 3 can be stably stored in the lower main body 4. Since the first coupling convex portion 11 of the first connector 5 can be fitted into the coupling concave portion 12 of the second connector 6, the upper main body 3 can be fixed to the lower main body 4 by coupling the first connector and the second connector.

Referring to FIG. 5, the leg receiving portion 31 for detachably attaching the leg 30 is provided at a lower portion of an outer periphery of the lower main body 4. In the present embodiment, the leg receiving portion 31 has a concave shape.

The leg 30 may include a stem 32 to be attached to and detached from the leg receiving portion 31 of the lower main body 4, and a plate 34 connected to one end of the stem 32. The other end of the stem 32 is provided with a first connecting portion 33 that can be coupled to the leg receiving portion 31 corresponding to the leg receiving portion 31. In the present embodiment, since the leg receiving portion 31 is provided in a concave shape, the first connecting portion 33 is formed in a convex shape. However, the first connecting portion 33 is not limited thereto, and may be provided in a concave shape when the leg receiving portion 31 is provided in a convex shape.

Figure 6:
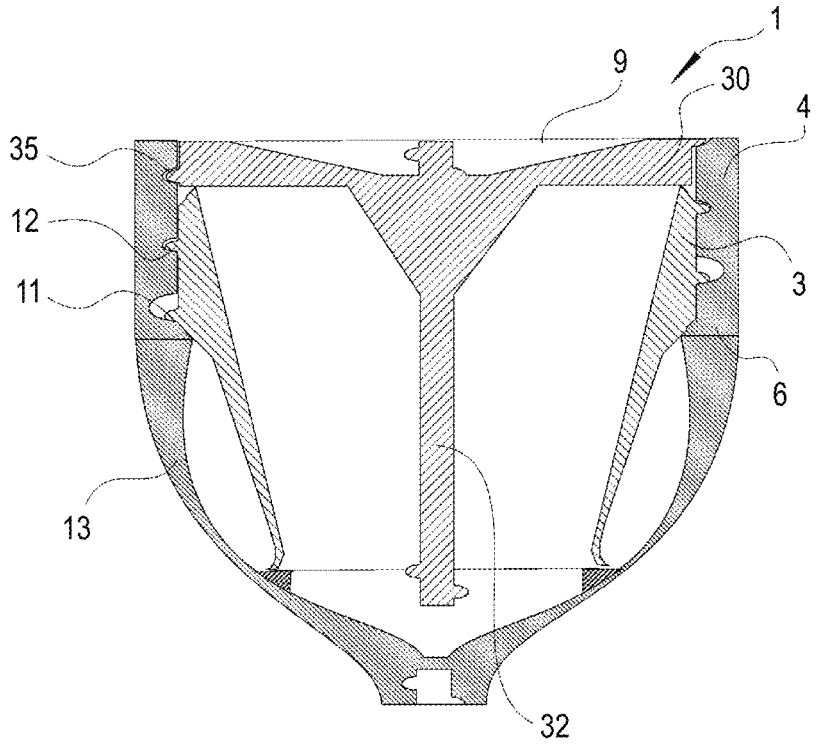
FIG. 6 is a diagram schematically illustrating a state in which the assembleable container according to the first embodiment is disassembled, and the upper main body and a leg are stored in the lower main body.

Next, FIG. 6 shows a diagram in which the upper main body 3 and the leg 30 are stored in the lower main body 4. When storing the leg 30 in the lower main body 4, the leg 30 is inserted upside down through the third opening 9 of the lower main body 4 and stored, thereby reducing the required storage space.

In the leg 30, a second coupling convex portion 35 is provided in the plate 34. The second coupling convex portion 35 is a convex portion provided on a side surface of the plate 34, and the leg 30 can be connected and fixed to the coupling concave portion 12 provided on an inner periphery of the second connector 6 using the second coupling convex portion 35.

In the present embodiment, since the coupling concave portion 12 is provided in a concave shape, the second coupling convex portion 35 is provided in a convex shape. However, the second coupling convex portion 35 is not limited thereto, and may be provided in a concave shape when the coupling concave portion 12 is provided in a convex shape.

The upper main body 3 is fixedly stored in the lower main body 4 by screwing the first coupling convex portion 11 into the coupling concave portion 12. As described above, since the length (stage) of the groove of the coupling concave portion 12 is longer than the length at which the first coupling convex portion 11 is coupled, the coupling concave portion 12 of the second connector 6 can be further coupled to the second coupling convex portion 35 of the leg 30 when the first coupling convex portion 11 is screwed.

Next, a state in which a plurality of assembleable containers I are stacked in multiple stages and connected will be described in detail with reference to FIG. 7. A plurality of assembleable containers 1 stored in the same manner can be stacked and connected in multiple stages.

Figure 7:
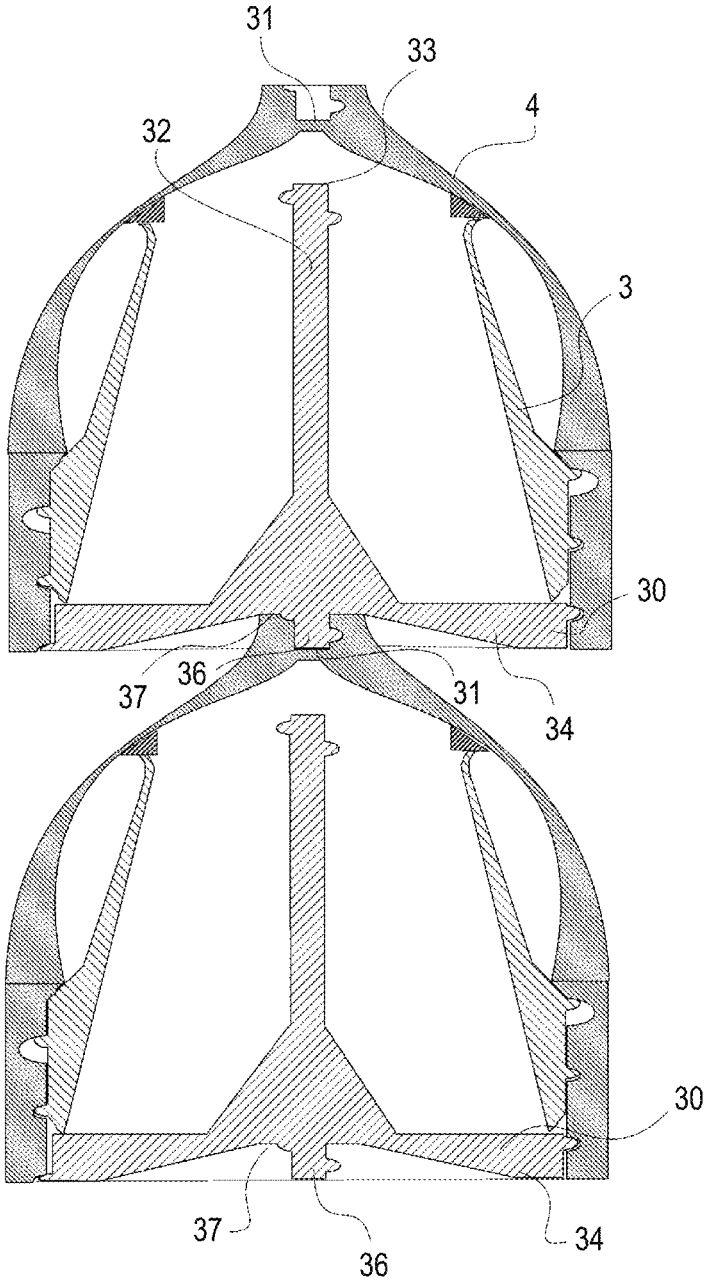
FIG. 7 is a diagram illustrating a state in which the assembleable containers according to the first embodiment are stacked and stored in two stages.

First, as shown in FIG. 7, a second connecting portion 36 having a protruding shape is provided on a bottom surface of the plate 34 of the leg 30.

The second connecting portion 36 can connect a plurality of containers in multiple stages by being coupled to the leg receiving portion 31 of the lower main body 4 when the leg 30 is stored in the lower main body 4.

By allowing a plurality of containers to be connected in multiple stages, the containers can be stacked vertically and a horizontal storage space can be reduced, making it easier to store the containers in a cupboard or backpack.

In the present embodiment, the second connecting portion 36 is provided in substantially the same shape as the first connecting portion 33. However, the second connecting portion 36 is not limited thereto, and may be provided in a convex shape as long as the second connecting portion 36 can be connected to the leg receiving portion 31.

A plate bottom surface 37 is provided near the second connecting portion 36. The plate bottom surfaces 37 face each other when the assembleable containers 1 are stacked and stored in multiple stages, and at least a part of the surfaces face each other and can partially come into contact with each other.

Since the assembleable container 1 has the plate bottom surface 37, the assembleable container 1 can be stacked more stably when the stored assembleable containers 1 are stacked and coupled vertically.

Figure 8:
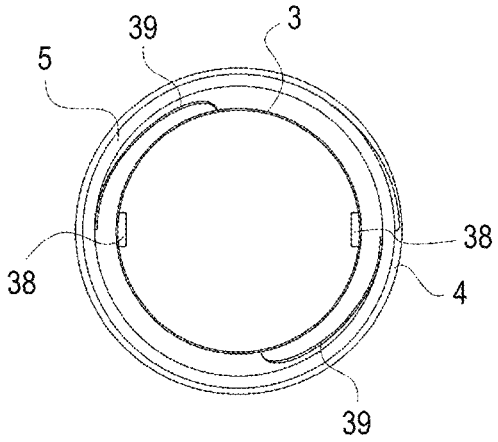
FIG. 8 is a diagram schematically showing a top view of the assembleable container according to the first embodiment.
Figure 9:
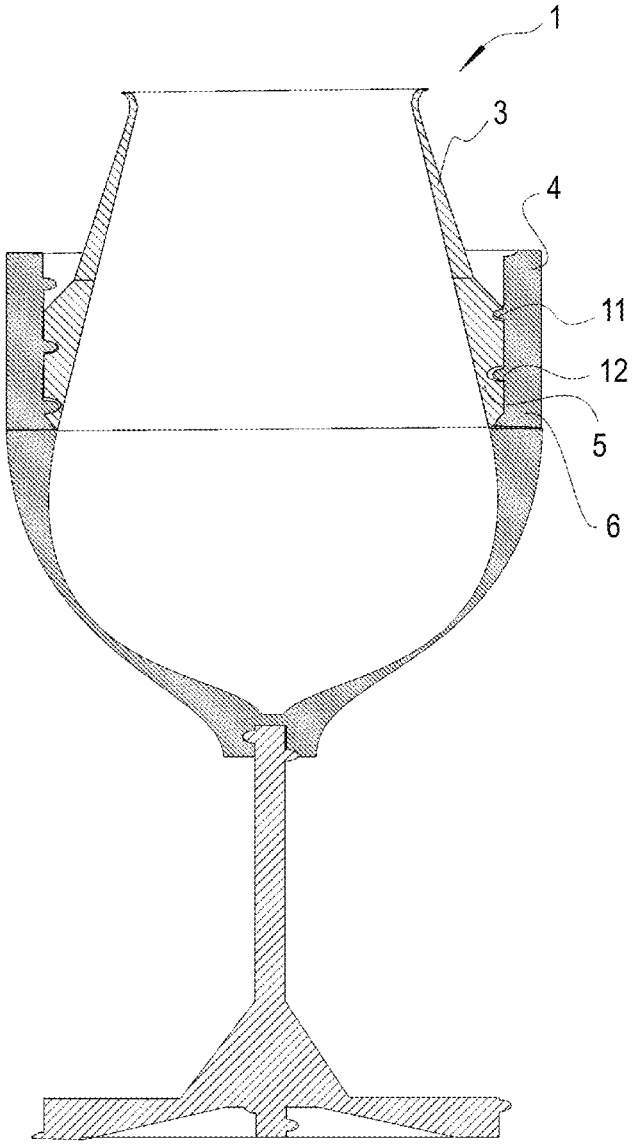
FIG. 9 is a diagram schematically showing a cross-sectional view of the assembleable container when the assembleable container is assembled.

Next, reinforcement that can be applied to the assembleable container 1 will be described with reference to FIG. 8. As shown in FIG. 8, when the assembleable containers 1 are stacked in multiple stages, the lower assembleable container 1 receives the weight of the stacked assembleable containers 1. In particular, the lower main body 4 and the leg 30 support the weight.

FIG. 8 is a top view of the assembleable container 1 when the upper main body 3, the lower main body 4, and the leg 30 are assembled. As shown in FIG. 8, stoppers 38 for supporting the upper main body 3 can be provided on an inner peripheral surface of the liquid storage portion 13.

In the present embodiment, the stoppers 38 have a convex shape and are disposed at two positions in the liquid storage portion 13. However, it is not necessary to limit the number of stoppers 38 to two, and for example, the stoppers 38 may be provided over the entire periphery of the liquid storage portion 13 near a surface facing the tubular portion 10, or may be provided as concave portions instead of convex portions on the inner peripheral surface of the liquid storage portion 13.

Since the assembleable container 1 has the stopper 38, the weight applied to the lower main body 4 and the leg 30 can be distributed to the upper main body 3.

Since screws are used when assembling and storing the assembleable container 1, twisting and rotating forces are generated in each member. As shown in FIG. 8, the assembleable container 1 may have reinforcing portions 39 provided to respond to the rotating force. In the present embodiment, the reinforcing portions 39 are provided at two positions outside the upper main body 3. However, the reinforcing portion 39 is not limited thereto, and may be provided on an inner peripheral surface of the lower main body 4 or the leg 30.

By providing the reinforcing portion 39 in the assembleable container 1, the force applied when disassembling and assembling the upper main body 3 and the lower main body 4 can be dispersed, and the assembleable container 1 can be hardly broken.

Second Embodiment

Next, an assembleable container 101 according to a second embodiment will be described. Similar to the assembleable container 1 described in the first embodiment. the assembleable container 101 can be freely assembled, disassembled, and stored. Hereinafter, the assembleable container 101 that is assembled will be described. In the assembleable container 101, the description of portions having the same configurations as those of the assembleable container 1 may be omitted.

Container Assembled

Figure 10:
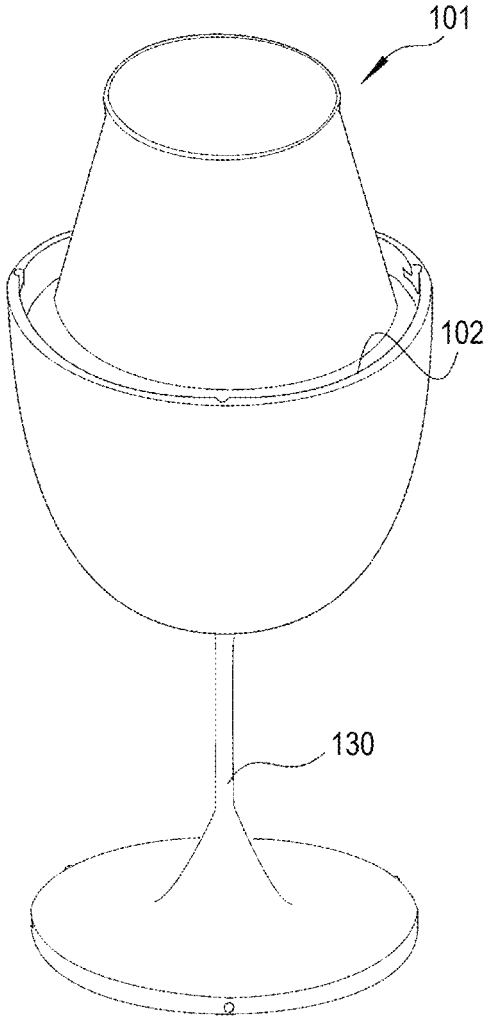
FIG. 10 is diagram schematically illustrating an assembleable container according to a second embodiment.
Figure 11:
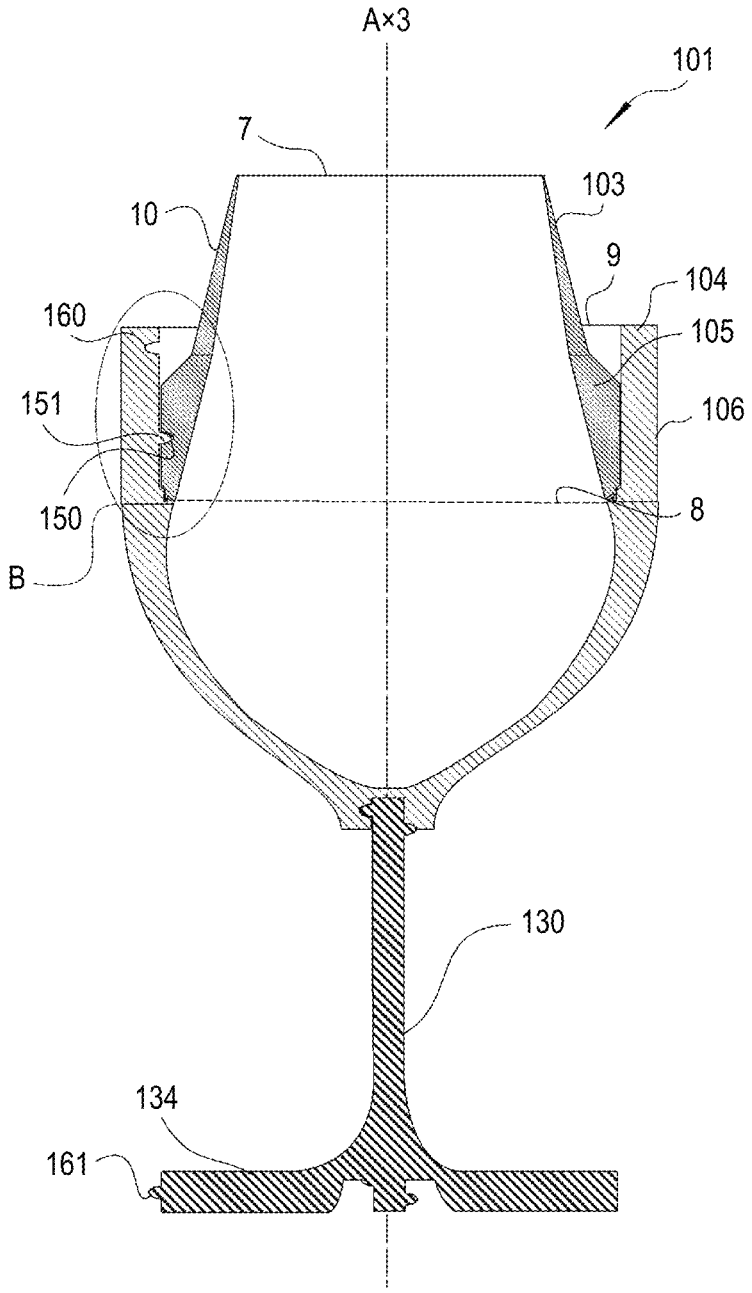
FIG. 11 is a diagram schematically showing a cross-sectional view of the assembleable container according to the second embodiment when the assembleable container is assembled.

FIG. 10 is a diagram schematically illustrating the assembleable container 101 according to the second embodiment. FIG. 10 is a perspective view of the assembleable container 101. FIG. 11 is a cross-sectional view of the assembleable container 101. In the drawing, a central axis A×3 of the assembleable container 101 is shown.

In FIG. 10, the assembleable container 101 may include a container main body 102 and a leg 130 which are vertically disposed in this order.

As shown in FIG. 11, the container main body 102 may include an upper main body 103 having a first connector 105 and a lower main body 104 having a second connector 106 coupled to the first connector 105 of the upper main body 103, and the upper main body 103 and the lower main body 104 are disposed in this order in an extending direction of the central axis A×3.

Next, the upper main body 103 will be described. As shown in FIG. 11, the upper main body 103 may include the tubular portion 10 and the first connector 105 for connecting to the lower main body 104. The first opening 7 is provided at the other end of the tubular portion 10.

The first connector 105 may have first joint portions 150 provided on an outer peripheral surface thereof for fixing to the second connector 106. The first joint portions 150 are fixing portions provided on the outer peripheral surface of the first connector 105, and are provided to fix the upper main body 103 and the lower main body 104 and prevent the upper main body 103 and the lower main body 104 from falling off when the first connector 105 and the second connector 106 are coupled.

In the present embodiment, the first joint portions 150 are provided in a concave shape at three positions on the outer peripheral surface of the first connector 105. However, the first joint portion 150 is not limited thereto, and only needs to be able to fix the first connector 105 of the upper main body 103 and the second connector 106 of the lower main body 104 and prevent the upper main body 103 and the lower main body 104 from falling off when the first connector 105 and the second connector 106 are coupled, as in the assembleable container 1 of the first embodiment. For example, the first joint portion 150 may be provided in a convex shape on the outer peripheral surface of the first connector 105, or may be continuously provided over the entire outer peripheral surface.

Referring to FIG. 11 again, the second connector 106 of the lower main body 104 has, on an inner peripheral surface thereof, second joint portions 151 having a convex shape corresponding to the first joint portions 150 of the first connector 105. When the first connector 105 of the upper main body 103 is fixed to the second connector 106 of the lower main body 104, the second joint portion 151 is fitted into the first joint portion 150, thereby fixing the upper main body 103 and the lower main body 104 and preventing the upper main body 103 and the lower main body 104 from falling off.

In the present embodiment, by fitting a convex portion of the second connector 106 into a concave portion of the first joint portion 150, the upper main body 103 can be fixed to the lower main body 104 without falling off.

Figure 13:
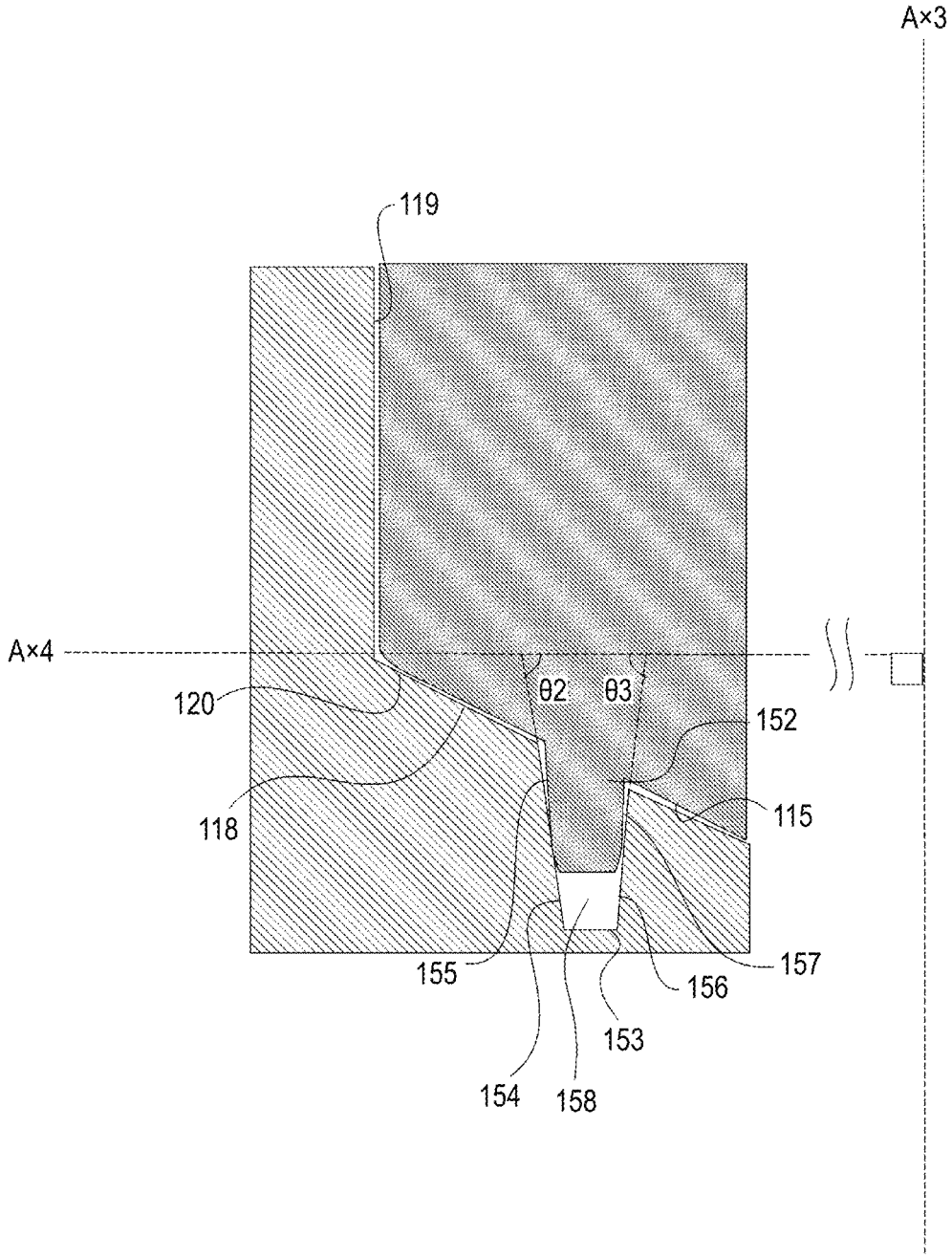
FIG. 13 is a schematic enlarged diagram of a portion C in FIG. 12.

In the present embodiment, when the first connector 105 and the second connector 106 are coupled, since the first connector 105 and the second connector 106 are directly coupled, a gap is formed between the first connector 105 and the second connector 106 (see FIG. 13).

Next, the lower main body 104 will be described with reference to FIG. 11 again. First, the third opening 9 is provided in an upper portion of the lower main body 104. The third opening 9 is in contact with one end of the second connector 106.

The second connector 106 of the lower main body 104 may have, on the inner peripheral surface thereof, the second joint portions 151 for joining to the first joint portions 150 of the first connector 105. The second joint portions 151 correspond to the shapes of the first joint portions 150, and are formed on the inner peripheral surface of the second connector 106.

Similar to the assembleable container 1 of the first embodiment, the disassembled upper main body 103 can be stored in the lower main body 104. At this time, the lower main body 104 can store the upper main body 103 and further store the leg 130.

When the leg 130 is stored in the lower main body 104, an inner peripheral side of the second connector 106 and the leg 130 face each other, and the lower main body 104 and the leg 130 can be fixed using a third joint portion 160 provided in the second connector 106 and can be prevented from falling off.

In the leg 130, a fourth joint portion 161 is provided in a plate 134. The fourth joint portion 161 is a convex portion provided on a side surface of the plate 134, and the leg 130 can be connected and fixed to the third joint portion 160 provided on the inner peripheral side of the second connector 106 using the fourth joint portion 161.

In the present embodiment, the third joint portion 160 is provided in a concave shape, and can be fitted into the fourth joint portion 161 of the leg 130. However, the third joint portion 160 is not limited thereto, and may be provided in a convex shape, for example, as long as the lower main body 104 and the leg 130 can be fixed and prevented from falling off when the leg 130 is stored in the lower main body 104. When the third joint portion 160 is provided in a convex shape, the fourth joint portion 161 of the leg 130 is correspondingly provided in a concave shape, for example, so that the leg 130 can be connected and fixed to the lower main body 104.

Figure 12:
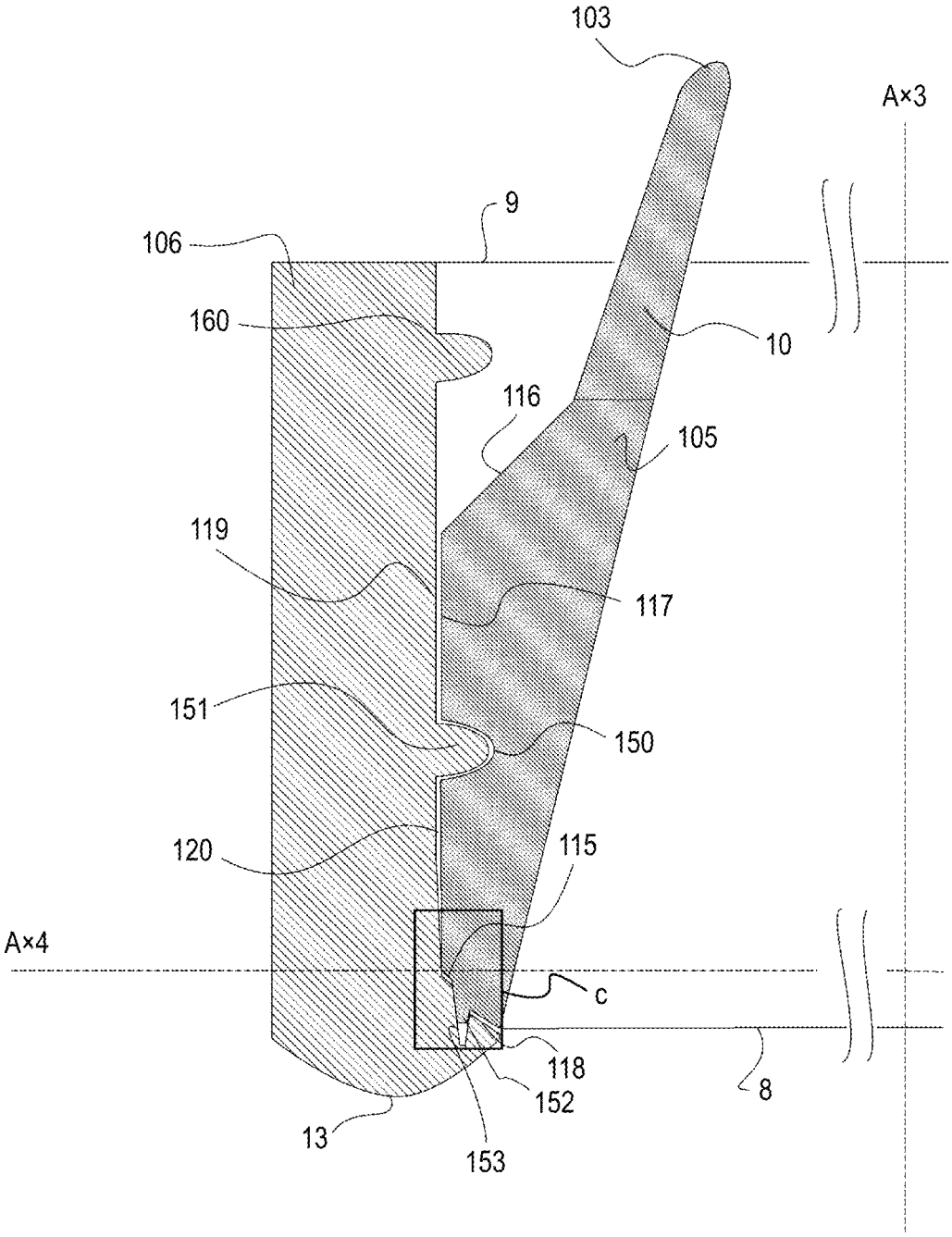
FIG. 12 is a schematic enlarged diagram of a portion B in FIG. 11.

Next, a state in which the upper main body 103 and the lower main body 104 are coupled will be described with reference to FIGS. 12 and 13. FIG. 12 is a cross-sectional view schematically showing a state in which a portion B shown in FIG. 11 is enlarged. FIG. 13 shows the central axis A×3 and a horizontal axis A×4 orthogonal to the central axis A×3. FIG. 13 is a cross-sectional view schematically showing a state in which a portion B in FIG. 12 is enlarged.

First, the first connector 105 will be described with reference to FIG. 12. As shown in FIG. 12, the first connector 105 is provided on a lower side of the tubular portion 10 of the upper main body 103. The first connector 105 may have a first connector outer peripheral surface 117, a first connector bottom surface 115, and a first connector upper surface 116.

The first connector outer peripheral surface 117 has one end, which is a lower side, connected to the first connector bottom surface 115, and has the other end, which is an upper side, connected to the first connector upper surface 116. The tubular portion 10 is provided on an upper portion of the first connector upper surface 116. On the other hand, the second opening 8 is provided in a lower portion of the first connector bottom surface 115.

Next, the second connector 106 will be described with reference to FIG. 12 again. As shown in FIG. 12, the second connector 106 is provided in an upper portion of the liquid storage portion 13. The second connector 106 may have a second connector inner peripheral surface 119 and a second connector bottom surface 118.

When the upper main body 103 and the lower main body 104 are coupled, the second connector inner peripheral surface 119 faces the first connector outer peripheral surface 117 of the upper main body 103 and can at least partially come into contact with the first connector outer peripheral surface 117. The second connector inner peripheral surface 119 has the third opening 9 at an upper portion thereof, and a lower portion thereof is connected to the second connector bottom surface 118.

An upper portion of one end of the second connector bottom surface 118 is connected to the second connector inner peripheral surface 119. The liquid storage portion 13 is provided at the other end of the second connector bottom surface 118.

When the upper main body 103 and the lower main body 104 are assembled, the second connector bottom surface 118 faces the first connector bottom surface 115 of the first connector 105 and can at least partially come into contact with the connector bottom surface 115.

As will be described in detail later, the second connector bottom surface 118 may have a second water stop portion 153. The second water stop portion 153 is provided in a concave shape over the entire periphery of the second connector bottom surface 118.

Figure 14:
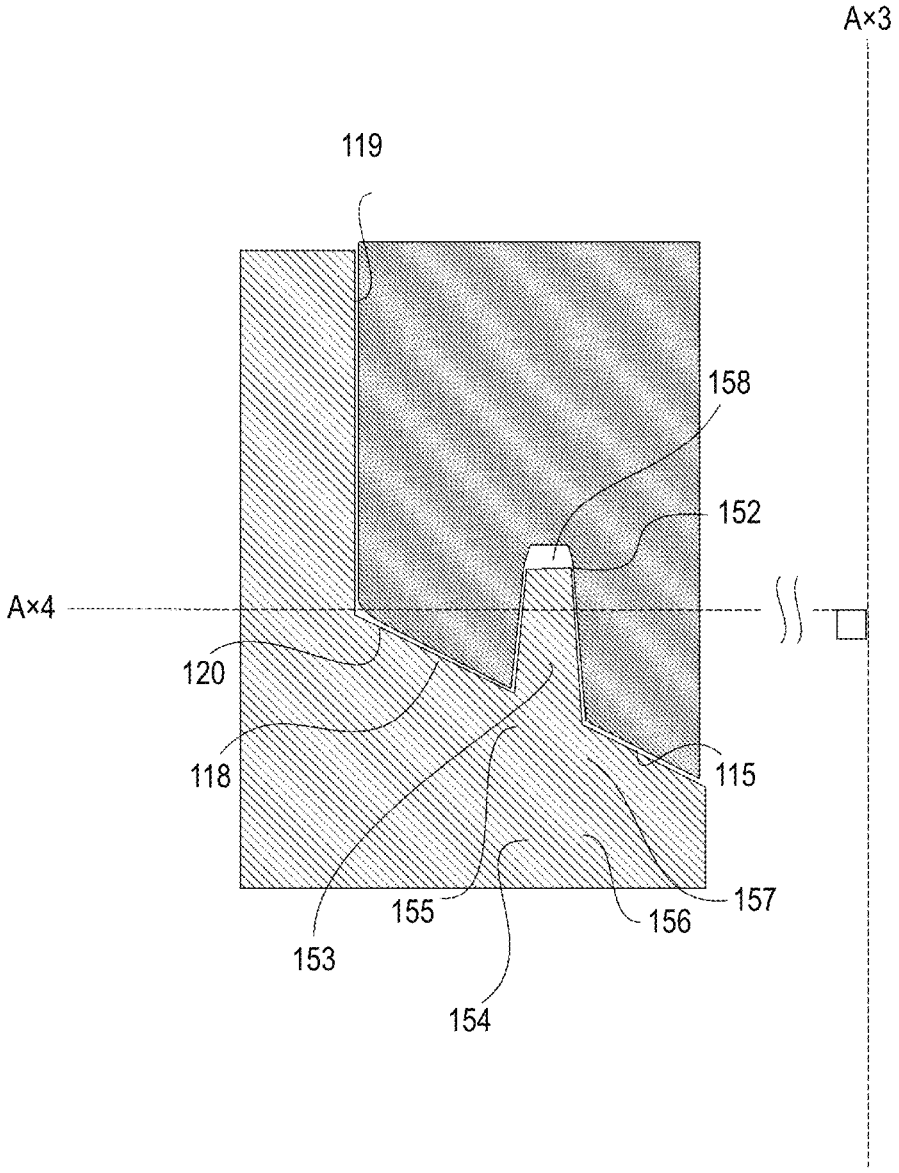
FIG. 14 is a diagram schematically showing a cross-sectional view of the assembleable container according to the second embodiment when the assembleable container is assembled.

In the present embodiment, the second water stop portion 153 is provided in a concave shape. However, the second water stop portion 153 is not limited thereto, and may be provided in a convex shape, for example (see FIG. 14).

On the other hand, the first connector bottom surface 115 may also have a first water stop portion 152 corresponding to the second water stop portion 153. The first water stop portion 152 is provided over the entire periphery of the first connector bottom surface 115, faces the second water stop portion 153 of the second connector bottom surface 118, and can at least partially come into contact with the second water stop portion 153.

When the first connector 105 and the second connector 106 are coupled, the first water stop portion 152 and the second water stop portion 153 face each other and can at least partially come into contact with each other.

In the present embodiment, the first water stop portion 152 is provided in a convex shape corresponding to the second water stop portion 153. However, the present invention is not limited thereto, and the first water stop portion 152 may be provided in a concave shape as long as the first water stop portion 152 faces the second water stop portion 153 and can partially come into contact with the second water stop portion 153 (see FIG. 14).

Next, a relation between the first connector 105 and the second connector 106 will be described with reference to FIG. 12 again.

When the upper main body 103 and the lower main body 104 are assembled in the assembleable container 101, the first connector 105 and the second connector 106 are coupled, and one end of the coupled first connector outer peripheral surface 117 and second connector inner peripheral surface 119 is connected to the outside of the container main body 102, and the other end is connected to a coupling portion between the first connector bottom surface 115 and the second connector bottom surface 118. Further, the other end of the coupling portion between the first connector bottom surface 115 and the second connector bottom surface 118 is connected to the liquid storage portion 13.

It may be difficult to form the coupled first connector bottom surface 115 and second connector bottom surface 118 so as to be in contact with each other over the entire surface, and it may be difficult to form the coupled first connector outer peripheral surface 117 and second connector inner peripheral surface 119 so as to be in contact with each other over the entire surface.

In the assembleable container 101, since the first connector 105 and the second connector 106 are directly coupled without providing a sealing member such as a packing between the first connector 105 and the second connector 106, when the first connector 105 and the second connector 106 are coupled, a cavity 120 is formed between the first connector 105 and the second connector 106.

When drinking the liquid 14 using the assembleable container 101, the assembleable container 101 is inclined, and the liquid 14 may reach the cavity 120 between the first connector outer peripheral surface 117 and the second connector inner peripheral surface 119 from the liquid storage portion 13 through the cavity 120 between the first connector bottom surface 115 and the second connector bottom surface 118, and may further leak to the outside.

However, for example, even if the liquid 14 flows from the liquid storage portion 13 into the cavity 120 via the first connector bottom surface 115 and the second connector bottom surface 118, the first connector bottom surface 115 and the second connector bottom surface 118 facing each other and the first connector outer peripheral surface 117 and the second connector inner peripheral surface 119 facing each other each have a leakage prevention portion, so that the flow of the liquid 14 can be blocked, and the liquid 14 can be prevented from leaking from the cavity 120 to the outside of the assembleable container 101.

Next, a state in which the upper main body 103 and the lower main body 104 are coupled will be described in detail with reference to FIG. 13. FIG. 13 shows the central axis A×3 and the horizontal axis A×4.

First, as shown in FIG. 13, the first water stop portion 152 of the first connector bottom surface 115 and the second water stop portion 153 of the second connector bottom surface 118 will be described.

As described above, the first connector bottom surface 115 may have the first water stop portion 152 having a convex or concave shape. The second connector bottom surface 118 may have the second water stop portion 153 having a concave or convex shape corresponding to the shape of the first water stop portion 152.

The first water stop portion 152 and the second water stop portion 153 are leakage prevention portions that can at least partially come into contact with each other when the first connector bottom surface 115 and the second connector bottom surface 118 are disposed facing each other.

In the present embodiment, the first water stop portion 152 and the second water stop portion 153 can be fitted, and when the first connector 105 and the second connector 106 are coupled, the first water stop portion 152 is fitted into the second water stop portion 153, so that the first water stop portion 152 is inserted into the second water stop portion 153, and an outer peripheral surface of the first water stop portion 152 faces an outer peripheral surface of the second water stop portion 153 and can at least partially come into contact with the outer peripheral surface of the second water stop portion 153.

Since a part of the first water stop portion 152 and the second water stop portion 153 form a contact portion, the cavity 120 can be blocked, and when the liquid 14 is poured into the assembleable container 101 and inclined, the liquid 14 can be effectively prevented from leaking to the outside of the assembleable container 101 from the cavity 120.

Since the first water stop portion 152 faces the second water stop portion 153, the cavity 120 between the first connector bottom surface 115 and the second connector bottom surface 118 is extended as compared with a case where the cavity 120 is formed substantially horizontally.

By extending the cavity 120, when the liquid 14 is poured into the assembleable container 101 and inclined, the amount of the liquid 14 leaking from the cavity 120 to the outside of the assembleable container 101 can be effectively reduced since a length at which the frictional resistance of a conduit is received from the cavity 120 increases, for example.

Next, referring to FIG. 13 again, both the first water stop portion 152 and the second water stop portion 153 are provided with inclined tapered portions on a side surface on an outer peripheral side in a radial direction and a side surface on an inner peripheral side in a radial direction.

The tapered portions provided in the first water stop portion 152 and the second water stop portion 153 are formed such that a width decreases from an opening toward a tip.

First, as shown in FIG. 13, the second water stop portion 153 may have, on the side surface in the outer peripheral side in the radial direction, a second water stop portion outer peripheral tapered portion 154 that is inclined upwardly toward the outside in the radial direction by an angle θ2 with respect to the horizontal axis A×4.

The first water stop portion 152 may have a first water stop portion outer peripheral tapered portion 155 on the side surface on the outer peripheral side in the radial direction.

Next, the second water stop portion 153 may have, on the inner peripheral side surface in the radial direction, a second water stop portion inner peripheral tapered portion 156 that is inclined upwardly toward the inside in the radial direction by an angle θ3 with respect to the horizontal axis A×4.

The first water stop portion 152 may have a first water stop portion inner peripheral tapered portion 157 on the inner peripheral side surface in the radial direction.

As described above, the first water stop portion 152 faces the second water stop portion 153, and can partially come into contact with the second water stop portion 153. Therefore, the first water stop portion outer peripheral tapered portion 155 and the second water stop portion outer peripheral tapered portion 154, and the first water stop portion inner peripheral tapered portion 157 and the second water stop portion inner peripheral tapered portion 156 face each other and can partially come into contact with each other.

In the present embodiment, when the assembleable container 101 is assembled, the second water stop portion outer peripheral tapered portion 154 and the first water stop portion outer peripheral tapered portion 155 face each other while being inclined at an angle of approximately θ2 with respect to the horizontal axis A×4, and can at least partially come into contact with each other. The second water stop portion inner peripheral tapered portion 156 and the first water stop portion inner peripheral tapered portion 157 also face each other while being inclined at an angle of approximately θ3 with respect to the horizontal axis A×4, and can at least partially come into contact with each other.

Since the second water stop portion outer peripheral tapered portion 154 and the first water stop portion outer peripheral tapered portion 155 face each other while being inclined from the horizontal axis A×4 at an angle of approximately θ2, the cavity 120 between the second water stop portion outer peripheral tapered portion 154 and the first water stop portion outer peripheral tapered portion 155 is also inclined. Since the second water stop portion inner peripheral tapered portion 156 and the first water stop portion inner peripheral tapered portion 157 face each other while being inclined from the horizontal axis A×4 at an angle of substantially θ3, the cavity 120 between the second water stop portion inner peripheral tapered portion 156 and the first water stop portion inner peripheral tapered portion 157 is also inclined.

Since the cavity 120 is inclined, when the liquid 14 is poured into the assembleable container 101 and inclined, for example, the volume of the liquid 14 that can be held in the cavity 120 increases, and thus the amount of the liquid 14 moving from the cavity 120 to the outside of the assembleable container 101 can be effectively reduced.

Further, when the first water stop portion 152 and the second water stop portion 153 face each other, the second water stop portion outer peripheral tapered portion 154 and the first water stop portion outer peripheral tapered portion 155, and the second water stop portion inner peripheral tapered portion 156 and the first water stop portion inner peripheral tapered portion 157 can partially form a contact portion.

Since the second water stop portion outer peripheral tapered portion 154 and the first water stop portion outer peripheral tapered portion 155, and the second water stop portion inner peripheral tapered portion 156 and the first water stop portion inner peripheral tapered portion 157 form the contact portion, the cavity 120 can be blocked, and when the liquid 14 is poured into the assembleable container 101 and inclined, the liquid 14 can be effectively prevented from leaking to the outside of the assembleable container 101 from the cavity 120.

The angle θ2 is an angle formed by an extension line of the second water stop portion outer peripheral tapered portion 154 and the horizontal axis A×4 in a downward direction toward an inner side in a radial direction, and can be set in a range of "45 degrees<θ2<90 degrees", for example.

The angle θ3 is an angle formed by an extension line of the second water stop portion inner peripheral tapered portion 156 and the horizontal axis A×4 in a downward direction toward an outer side in a radial direction, and can be set in a range of "45 degrees<θ3<90 degrees", for example.

In the present embodiment, the second water stop portion outer peripheral tapered portion 154 is provided along the entire periphery of the second water stop portion 153 on the outer peripheral side in the radial direction. The second water stop portion inner peripheral tapered portion 156 can be provided along the entire periphery on the inner peripheral side in the radial direction of the second water stop portion 153. However, the present invention is not limited thereto, and the second water stop portion outer peripheral tapered portion 154 and the second water stop portion inner peripheral tapered portion 156 may be partially provided in the second water stop portion 153.

In the present embodiment, the second water stop portion outer peripheral tapered portion 154 is provided at an equal angle over the entire periphery of the second water stop portion 153. The second water stop portion inner peripheral tapered portion 156 is also provided at an equal angle over the entire periphery of the second water stop portion 153. However, the present invention is not limited thereto, and the second water stop portion outer peripheral tapered portion 154 and the second water stop portion inner peripheral tapered portion 156 may be provided on the second water stop portion 153 at a plurality of different angles, for example.

Next, the second water stop portion 153 will be described with reference to FIG. 13 again. As shown in FIG. 13, the second water stop portion 153 may have a water storage portion 158.

The water storage portion 158 is a concave leakage prevention portion provided in the second water stop portion 153.

When the first connector bottom surface 115 and the second connector bottom surface 118 are disposed facing each other, the water storage portion 158 can form a space between the first water stop portion 152 and the second water stop portion 153 to hold the liquid 14.

Since an additional space is formed in the cavity 120 between the first water stop portion 152 and the second water stop portion 153, when the liquid 14 is poured into the assembleable container 101, for example, it is possible to effectively prevent the liquid 14 from moving and leaking to the outside of the cavity 120 due to capillary action.

Even if the liquid 14 is present between the first water stop portion 152 and the second water stop portion 153, by standing the assembleable container 101 upright. the liquid 14 can be moved in a downward direction of the cavity 120 and can be stored in the water storage portion 158.

In the present embodiment, the water storage portion 158 is provided at one position of the second water stop portion 153. However, the water storage portion 158 is not limited thereto, and may be provided over the entire periphery of the second water stop portion 153, for example.

In the present embodiment, since the second water stop portion 153 is provided in a concave shape, the water storage portion 158 is provided as an extending portion of the concave portion of the second water stop portion 153. However, the water storage portion 158 is not limited thereto, and may be provided as a shortened portion of the second water stop portion 153 when the second water stop portion 153 is provided in a convex shape, as long as an additional space is formed in the cavity 120 between the first water stop portion 152 and the second water stop portion 153 (see FIG. 14).

In the first and second embodiments, although the wine glass has been described as the assembleable container, the assembleable container is not limited to the wine glass and can be applied to a container in which the liquid 14 is stored, such as cups used in general households and restaurants, containers for takeout, or water bottles carried outdoors.

The method of coupling the first connector 105 and the second connector 106 is not limited to the methods described above, and other members such as elasticity, friction fixation, packing, and slip stoppers may be used.

Although the principle of the present invention has been illustrated and described in the preferred embodiments, those skilled in the art could recognized that the present invention can be changed in the arrangement and details without departing from such a principle. The present invention is not limited to the specific configurations disclosed in the present embodiments. Therefore, all modifications and changes that come within the scope and spirit of the claims are claimed.

REFERENCE SIGNS LIST

1, 101 assembleable container
2, 102 container main body
3, 103 upper main body
4, 104 lower main body
5, 105 first connector
6, 106 second connector
7 first opening
8 second opening
9 third opening
10 tubular portion
11 first coupling convex portion
12 coupling concave portion
13 liquid storage portion
14 liquid
15, 115 first connector bottom surface
16, 116 first connector upper surface
17, 117 first connector outer peripheral surface
18, 118 second connector bottom surface
19, 119 second connector inner peripheral surface
20, 120 cavity
21 first connector bottom surface step portion
22 second connector bottom surface step portion
23 inclined surface
24 wall
25 groove
30, 130 leg
31 leg receiving portion
32 stem
33 first connecting portion
34, 134 plate
35 second coupling convex portion
36 second connecting portion
37 plate bottom surface
38 stopper
39 reinforcing portion
150 first joint portion
151 second joint portion
152 first water stop portion
153 second water stop portion
154 second water stop portion outer peripheral tapered portion

155 first water stop portion outer peripheral tapered portion
156 second water stop portion inner peripheral tapered portion
157 first water stop portion inner peripheral tapered portion
158 water storage portion
160 third joint portion
161 fourth joint portion

The invention claimed is:

1. An assembleable container for storing a liquid, comprising:

an upper main body having a first connector; and a lower main body having a second connector configured to be coupled to the first connector of the upper main body, wherein the upper main body and the lower main body are configured to be assembled and/or disassembled using the first connector and the second connector, the first connector has a convex portion or a concave portion formed on an outer periphery of the upper main body, the second connector has a concave portion or a convex portion that is formed on an inner periphery of the lower main body and configured to fit into the convex portion or the concave portion of the first connector, when the first connector and the second connector are coupled to each other, a bottom surface of the first connector and a bottom surface of the second connector are disposed facing each other, the first connector and the second connector are coupled so as to provide a leakage prevention portion for preventing the liquid from leaking, the upper main body is configured to be separated from the lower main body and stored in the lower main body, when storing the upper main body in the lower main body, the upper main body is configured to be fixed to and stored in the lower main body by inserting the first connector upside down through an opening of the lower main body, and by fitting the convex portion of the first connector into the concave portion of the second connector, in a case where the first connector has the convex portion and the second connector has the concave portion corresponding to the convex portion of the first connector, or by fitting the concave portion of the first connector into the convex portion of the second connector, in a case where the first connector has the concave portion and the second connector has the convex portion corresponding to the concave portion of the first connector, the bottom surface of the first connector has a first water stop portion having a convex or concave shape, the bottom surface of the second connector has a second water stop portion having a concave or convex shape corresponding to the shape of the first water stop portion, the convex or concave shape of the second water stop portion has a tapered shape whose width decreases toward a tip direction, and when the bottom surface of the first connector and the bottom surface of the second connector are disposed facing each other, the first water stop portion and the second water stop portion are disposed facing each other and function as the leakage prevention portion.

2. The assembleable container according to claim 1, wherein the second water stop portion has a water storage portion having a concave shape, and when the first water stop portion and the second water stop portion are disposed facing each other, a space for holding a liquid in the water storage portion is formed therein, and the water storage portion forms the leakage prevention portion.

3. The assembleable container according to claim 1, wherein the bottom surface of the second connector has an inclined surface inclined downward toward an inner side in a radial direction.

4. The assembleable container according to claim 1, wherein the lower main body has a leg receiving portion on an outer peripheral bottom surface and further includes a leg detachably provided on the leg receiving portion of the lower main body, the leg is configured to be separated from the lower main body and stored in the lower main body, the leg includes a stem configured to be attached to and detached from the lower main body, and a plate connected to the stem, and when storing the leg in the lower main body, by inserting the leg upside down through the opening of the lower main body and fitting the leg into the concave portion or the convex portion of the second connector, the leg is configured to be coupled to the lower main body.

5. The assembleable container according to claim 4, wherein the leg has a second connecting portion having a protruding shape at a side of a bottom surface of the plate, and when the leg is stored in the lower main body, the lower main body is configured to be coupled in multiple stages by coupling the second connecting portion of the leg to the leg receiving portion of the lower main body.

6. The assembleable container according to claim 5, wherein the lower main body is configured to be coupled in multiple stages when the upper main body is stored in the lower main body.

7. An assembleable container for storing a liquid, comprising:

an upper main body having a first connector; and a lower main body having a second connector configured to be coupled to the first connector of the upper main body, wherein the upper main body and the lower main body are configured to be assembled and/or disassembled using the first connector and the second connector, the first connector has a convex portion or a concave portion formed on an outer periphery of the upper main body, the second connector has a concave portion or a convex portion that is formed on an inner periphery of the lower main body and configured to fit into the convex portion or the concave portion of the first connector, when the first connector and the second connector are coupled to each other, a bottom surface of the first connector and a bottom surface of the second connector are disposed facing each other, the first connector and the second connector are coupled so as to provide a leakage prevention portion for preventing the liquid from leaking, the upper main body is configured to be separated from the lower main body and stored in the lower main body, when storing the upper main body in the lower main body, the upper main body is configured to be fixed to and stored in the lower main body by inserting the first connector upside down through an opening of the lower main body, and by fitting the convex portion of the first connector into the concave portion of the second connector, in a case where the first connector has the convex portion and the second connector has the concave portion corresponding to the convex portion of the first connector, or by fitting the concave portion of the first connector into the convex portion of the second connector, in a case where the first connector has the concave portion and the second connector has the convex portion corresponding to the concave portion of the first connector, the lower main body has a leg receiving portion on an outer peripheral bottom surface and further includes a leg detachably provided on the leg receiving portion of the lower main body, the leg is configured to be separated from the lower main body and stored in the lower main body, the leg includes a stem configured to be attached to and detached from the lower main body, and a plate connected to the stem, and when storing the leg in the lower main body, by inserting the leg upside down through the opening of the lower main body and fitting the leg into the concave portion or the convex portion of the second connector, the leg is configured to be coupled to the lower main body.

8. The assembleable container according to claim 7, wherein the leg has a second connecting portion having a protruding shape at a side of a bottom surface of the plate, and when the leg is stored in the lower main body, the lower main body is configured to be coupled in multiple stages by coupling the second connecting portion of the leg to the leg receiving portion of the lower main body.

9. The assembleable container according to claim 8, wherein the lower main body is configured to be coupled in multiple stages when the upper main body is stored in the lower main body.

* * * * *